US007712341B2

(12) United States Patent
Johansson et al.

(10) Patent No.: US 7,712,341 B2
(45) Date of Patent: May 11, 2010

(54) ELECTRONIC COMBINATION LOCK

(76) Inventors: Fritz Hugo Johansson, 2512 S. Playa, Mesa, AZ (US) 85202; James P. Davidson, 402 Cliff Dr., Aptos, CA (US) 95003

( * ) Notice: Subject to any disclaimer, the term of this patent is extended or adjusted under 35 U.S.C. 154(b) by 280 days.

(21) Appl. No.: 11/847,209

(22) Filed: Aug. 29, 2007

(65) Prior Publication Data

US 2008/0060393 A1 Mar. 13, 2008

Related U.S. Application Data

(60) Provisional application No. 60/824,871, filed on Sep. 7, 2006.

(51) Int. Cl.
*E05B 49/00* (2006.01)
*E05B 47/00* (2006.01)

(52) U.S. Cl. ..... 70/278.3; 70/277; 70/493

(58) Field of Classification Search ..... 70/276, 70/277, 278.1, 278.2, 278.3, 278.5, 278.6, 70/278.7, 279.1, 280–283, 283.1, 284, 285, 70/493, 207

See application file for complete search history.

(56) References Cited

U.S. PATENT DOCUMENTS 2,879,659 A * 3/1959 Jacobi ..... 70/493
3,812,403 A * 5/1974 Gartner ..... 340/5.54
4,107,963 A 8/1978 Yorio et al.
4,162,623 A 7/1979 Yorio et al.
4,457,148 A 7/1984 Johansson et al.
4,770,012 A 9/1988 Johansson et al.
4,901,545 A * 2/1990 Bacon et al. ..... 70/278.3
4,998,426 A 3/1991 Genakis
5,000,019 A 3/1991 Foster
5,513,509 A 5/1996 Bergen
5,604,489 A * 2/1997 Hyatt, Jr. ..... 340/5.55
6,089,059 A 7/2000 Fan
6,151,935 A 11/2000 Evans et al.
6,378,344 B1 4/2002 Gartner
6,384,711 B1 5/2002 Cregger et al.
6,442,986 B1 * 9/2002 Russell et al. ..... 70/278.3
6,502,436 B2 1/2003 Beatty
7,069,755 B2 7/2006 Lies et al.
7,096,697 B2 8/2006 Keightly
7,240,526 B2 7/2007 Lee

FOREIGN PATENT DOCUMENTS

GB 2024922 A * 1/1980

OTHER PUBLICATIONS

"Pin tumbler lock," 2 web pages downloaded on Jul. 30, 2007 from http://en.wikipedia.org/wiki/Pin_tumbler_lock.
"The Yale pin tumbler," 2 web pages downloaded on Jul. 30, 2007 from http://www.yalelock.com/Yale/Templates/GlobalNormalWithMenu_1033.aspx.

* cited by examiner

*Primary Examiner*—Peter Cuomo
*Assistant Examiner*—Alyson M Merlino
(74) *Attorney, Agent, or Firm*—Patent Law Group LLP; Carmen C. Cook

(57) ABSTRACT

An electronic combination lock includes a door handle having a code entry button and housing a lock assembly and an electrical circuit. The lock assembly includes a lock body, a rotating cylinder, spring loaded lift lock pins and corresponding key pins, a reset cam path and a programming cam path formed on the cylinder, a lift comb for lifting the lift lock pins, a latch for latching the lift comb and a magnet being selectively activated to cause the latch to release the lift comb. The electrical circuit receives a first input signal indicative of an input code entered at the code entry button and a second input signal from a program switch actuated by the programming cam path and is operated to store an entry code when the program switch is actuated and to activate the magnet when an input code matching the stored entry code is received.

22 Claims, 21 Drawing Sheets

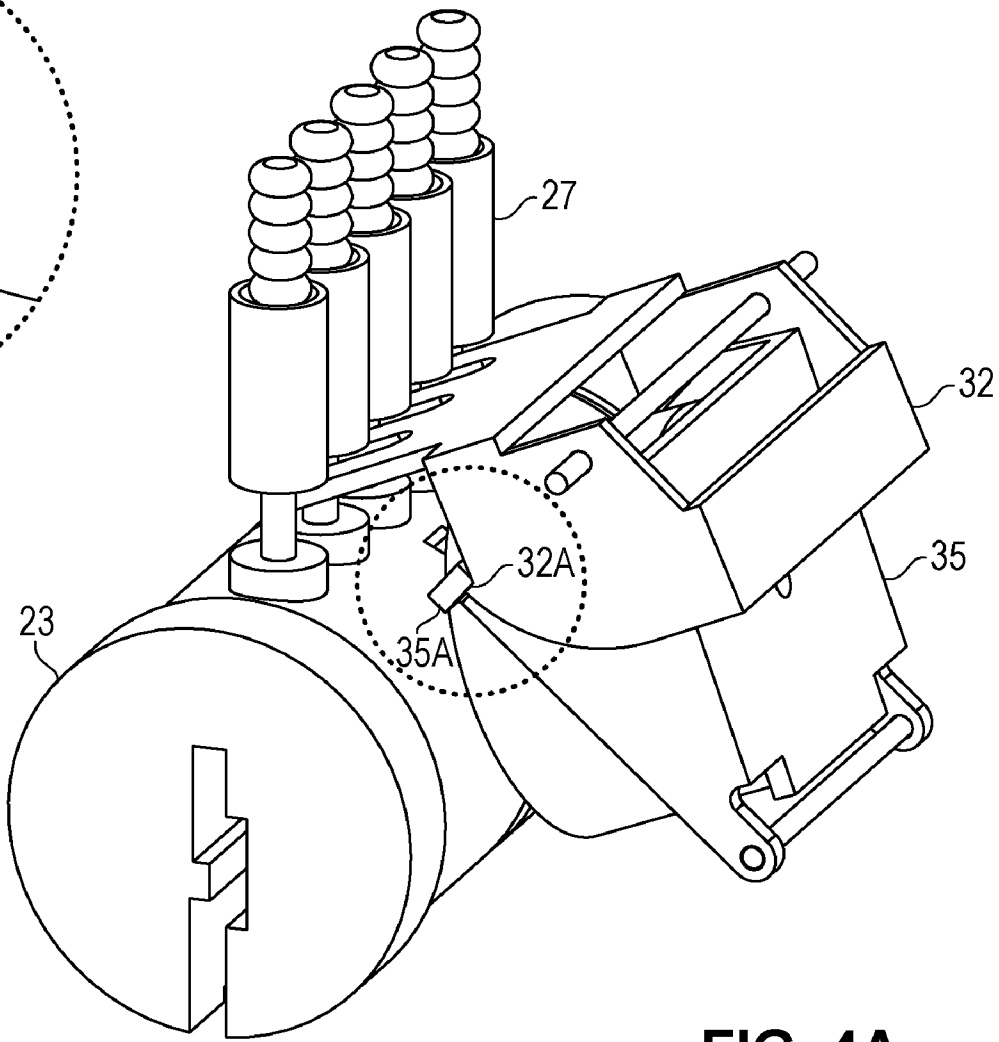
FIG. 4A
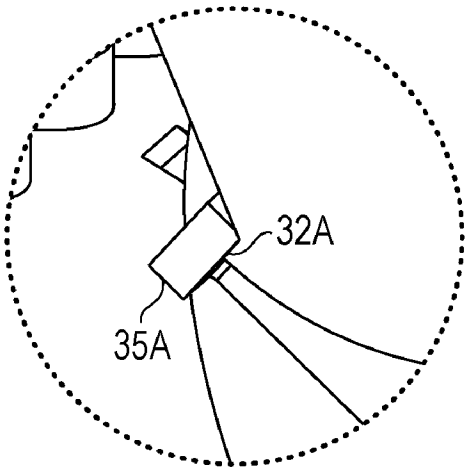
FIG. 4A(1)

ELECTRONIC COMBINATION LOCK

CROSS-REFERENCE TO RELATED APPLICATION

This application claims the benefit of U.S. Provisional Patent Application Ser. No. 60/824,871, filed on Sep. 7, 2006, having the same inventorship hereof, which application is incorporated herein by reference in its entirety.

FIELD OF THE INVENTION

The invention relates to a lock and, in particular, to an electronic combination lock that allows for keyed access and keyless access using a combination code.

DESCRIPTION OF THE RELATED ART

Electronic combination locks are currently in wide commercial use to control access to protected areas. These locks eliminate the need for a key and with it the problems associated with loss, theft or duplication of the keys. Access is gained to the protected area when the correct combination is entered into the lock, whereby the lock will be opened.

In one type of electronic digital combination lock, a panel of push buttons is mounted on a wall near a door, outside the protected area, while an electronic control box is mounted on the wall on the inside of the protected area. The panel may have ten numbered buttons and by pressing, for example, four buttons in proper sequence corresponding to the combination, a circuit in the control box will be activated to energize a solenoid of an electric door strike to allow the door to be opened.

U.S. Pat. No. 4,770,012 and U.S. Pat. No. 4,457,148, both to Johansson et al. describe another example of an electronic combination lock where the handle member of the door lock is rotated counterclockwise to enter the desired combination to unlock the lock.

The conventional electronic combination locks have many disadvantages. For example, if the access code is not changed often, the numeric key pad can get worn out, revealing the code used. Also, the electronic circuitry on some electronic combination locks is sensitive to heat and electrostatic discharge, shortening the lifetime of the lock.

Most of today's key locks are constructed using multi-pin locks, also known as pin-tumbler locks. The pin tumbler lock is a type of cylinder lock that uses pins of varying length to prevent the lock from opening without the correct key. More specifically, a set of key pins of unequal length, matching the pattern on a key, is positioned on in vertical bores formed in the lock cylinder. A corresponding set of spring-loaded driver pins or lift lock pins are positioned above the key pins. When a key is inserted, the key lifts the key pins until they are even with the outer diameter of the cylinder. The driver pins are pushed up and out of the cylinder and the pins are flush with the cylinder's outside diameter (the shear line). The cylinder can now be rotated to unlock the lock.

BRIEF DESCRIPTION OF THE DRAWINGS

FIGS. 4A and 4B illustrate the configuration of the lift comb and the latch in the latched and unlatched positions according to one embodiment of the present invention.

DETAILED DESCRIPTION OF THE PREFERRED EMBODIMENTS

Figure 1A:
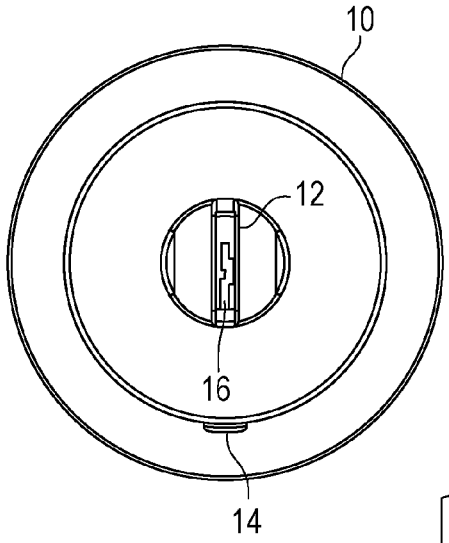
FIGS. 1A to 1C illustrate an external door handle incorporating the electronic combination lock according to one embodiment of the present invention.

In accordance with the principles of the present invention, an electronic combination lock enables keyed and keyless entry where keyless entry is realized by entering a digital code using a single button. The electronic combination lock includes a lock assembly for keyed and keyless access and an electrical circuit. The lock assembly and the electrical circuit are incorporated into a standard multi-pin lock and are housed entirely within the housing of the external door handle of the standard multi-pin lock. The lock assembly of the present invention, in response to the entry of the correct preprogrammed digital code, operates to duplicate the key action of a standard multi-pin lock to enable the lock to be locked or unlocked. In this manner, with the entry of the correct entry code, the lock is unlocked by turning the lock cylinder in the same manner as a key would turn the lock cylinder.

In the electronic combination lock of the present invention, the entry code is entered as sequential taps of a single code entry button. Programming of the desired entry code is initiated by entering of the new code via the code entry button and then storing the new code by rotating the lock cylinder using the key. For enhanced security, in one embodiment of the present invention, two rotations of the key, clockwise and counter-clockwise, are required to store the new code.

Overview of Lock Structure

The basic multi-pin cylinder locks or pin-tumbler cylinder locks have been applied in standard door locks or in deadbolt locks. In a standard door lock, the lock cylinder controls a door latch locking mechanism for a spring-driven door latch. The lock cylinder is rotated to lock or unlock the door latch locking mechanism while the door handle is rotated to retract the spring-driven door latch to open the door. The spring-driven door latch is automatically extended by the force of the spring when the door handle is not rotated against the force of the spring. Therefore, the door can be kept closed but unlocked. When the door latch locking mechanism is engaged, the spring-driven door latch is prevented from being retracted. In a deadbolt lock, the lock cylinder itself turns an attached cam to extend or retract the deadbolt directly. The application of the electronic combination lock of the present invention to a standard door lock is first described. The application of the electronic combination lock of the present invention to a deadbolt lock will be described later. Furthermore, the electronic combination lock of the present invention is directed to modification of the cylinder lock in the standard door locks and the standard deadbolts. Components of the standard door looks or deadbolt locks, such as the door latch, the door latch locking mechanism, the deadbolt cam, are not described or illustrated in the present description because these components are conventional.

In general, a standard door lock for a door includes an external handle for external access, an internal handle for internal operation, and a spring-driven door latch for engaging a mating recess in the door jamb. In the present description, the external handle is sometimes referred to as the external door knob while the internal handle member is sometimes referred to as the internal door knob. However, it is understood that the door handle can be formed either as a door knob or as a lever. The electronic combination lock of the present invention can be applied to door handles of any structures and configurations.

In the electronic combination lock of the present invention, the entire lock assembly and the electrical circuit are housed in the external door handle. Therefore, in the present description, only the structure of the external door handle is shown and described. It is understood that the external door handle will be coupled to an internal door handle to form a complete lock system. In the electronic combination lock of the present invention, the internal door handle is formed using conventional structures and will not be further described.

The electronic combination lock of the present invention can be manufactured as an external door handle which can be mated with a conventional internal door handle to form a complete lock system. Alternately, the electronic combination lock of the present invention can be manufactured as a complete set of lock including an external and an internal door handle. The internal door handle will be of conventional construction.

Figure 1B:
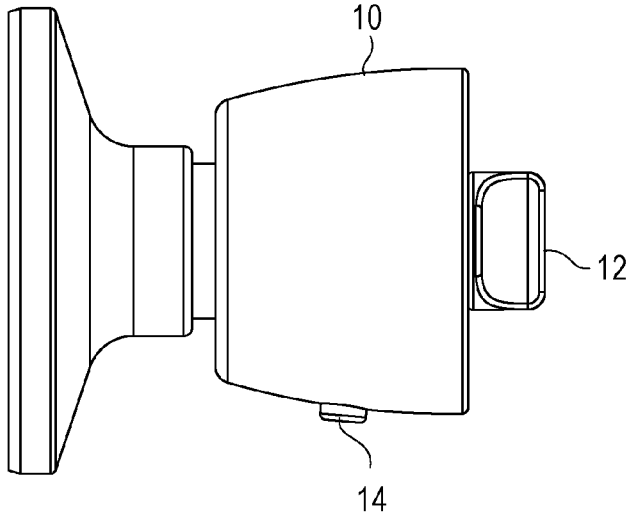
Figure 1C:
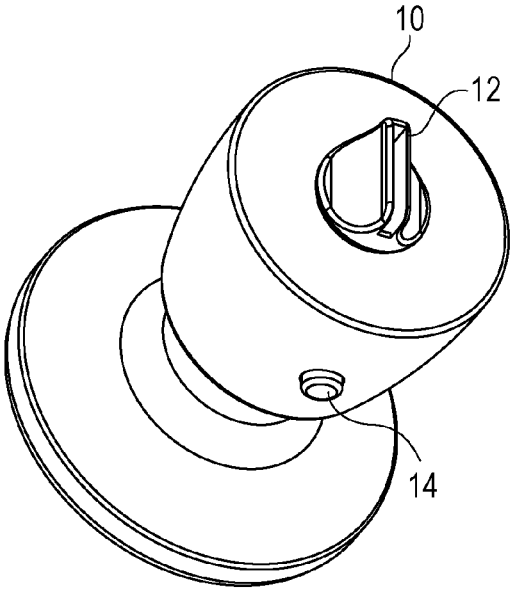

FIGS. 1A to 1C illustrate an external door handle incorporating the electronic combination lock according to one embodiment of the present invention. Referring to FIGS. 1A to 1C, an external door handle 10 is constructed in a similar manner to conventional door knobs with two exceptions. First, a turn button 12 is provided to allow the user to rotate the cylinder without a key. In the present embodiment, the turn button 12 is integrated with the key hole 16. Rotating the turn button 12 rotates the cylinder which unlocks the door latch locking mechanism. Second, a code entry button 14 is provided on the lock handle 10 to receive an entry code. In the present embodiment, code entry button 14 is positioned on the bottom-side of the door handle 10 to ensure privacy when the user enters the entry code. However, in other embodiments, the code entry button 14 can be positioned anywhere around the perimeter of the external door handle 10. Furthermore, in the present embodiment, the code entry button is a push button for actuating a switch on the electrical circuit of the electronic combination lock. In other embodiments, the code entry button can be a touch pad. The code entry button can be constructed using other means suitable for actuating a switching for inputting a sequential digital code.

The external door handle 10 in FIGS. 1A to 1C incorporates therein the entire electronic circuit and the lock assembly while maintaining the same size and dimensions of the conventional door handles. The external door handle 10 allows keyless access of the lock via entry of an entry code using the code entry button 14 and unlocking using the turn knob 12.

Lock Assembly

The electronic combination lock of the present invention is based on modifications that are made to a standard multi-pin lock escapement or standard pin tumbler lock. The basic construction of a multi-pin cylinder locks or pin tumbler locks is described in U.S. Pat. Nos. 4,107,963; 4,998,426; and 5,000,019, which patents are incorporated herein by reference in their entireties. The electronic combination lock of the present invention modifies the basic multi-pin cylinder locks and adapts the basic multi-pin cylinder locks for keyless entry. The basic multi-pin cylinder lock mechanism using key entry remains unchanged.

A salient feature of the electronic combination lock of the present invention is that the lock assembly imitates the lock and unlock mechanism of the basic multi-pin cylinder locks. The operation principal of the electronic combination lock is based on lifting of the lift lock pins of the cylinder lock to allow the cylinder to be rotated, in the same manner as when a key is used. The electronic combination lock of the present invention incorporates a lock assembly to lift the lift lock pins when the correct entry code is received and the lock can thereby be unlocked without a key.

Figure 2A:
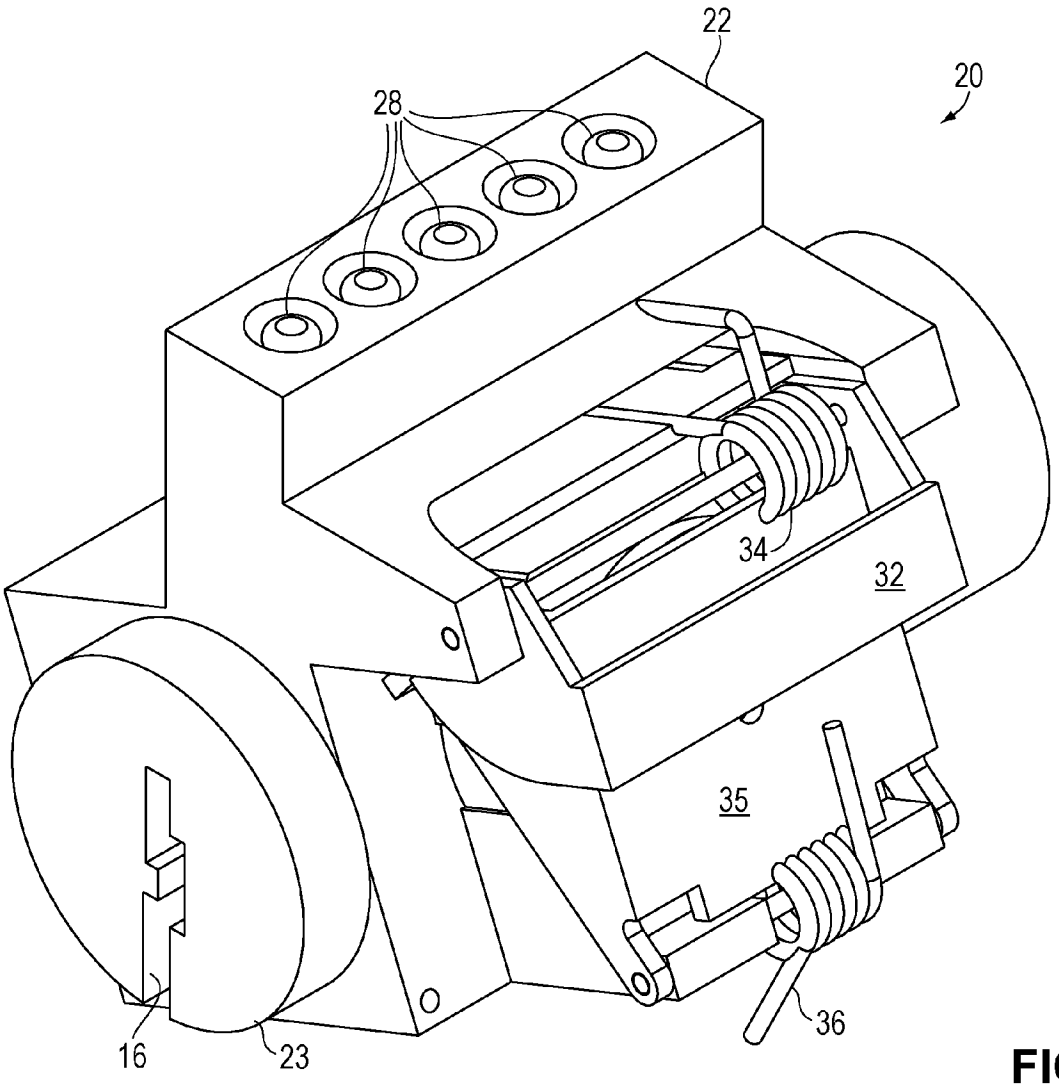
FIGS. 2A-2C are the isometric and exploded views of the lock assembly of the electronic combination lock according to one embodiment of the present invention.
Figure 2B:
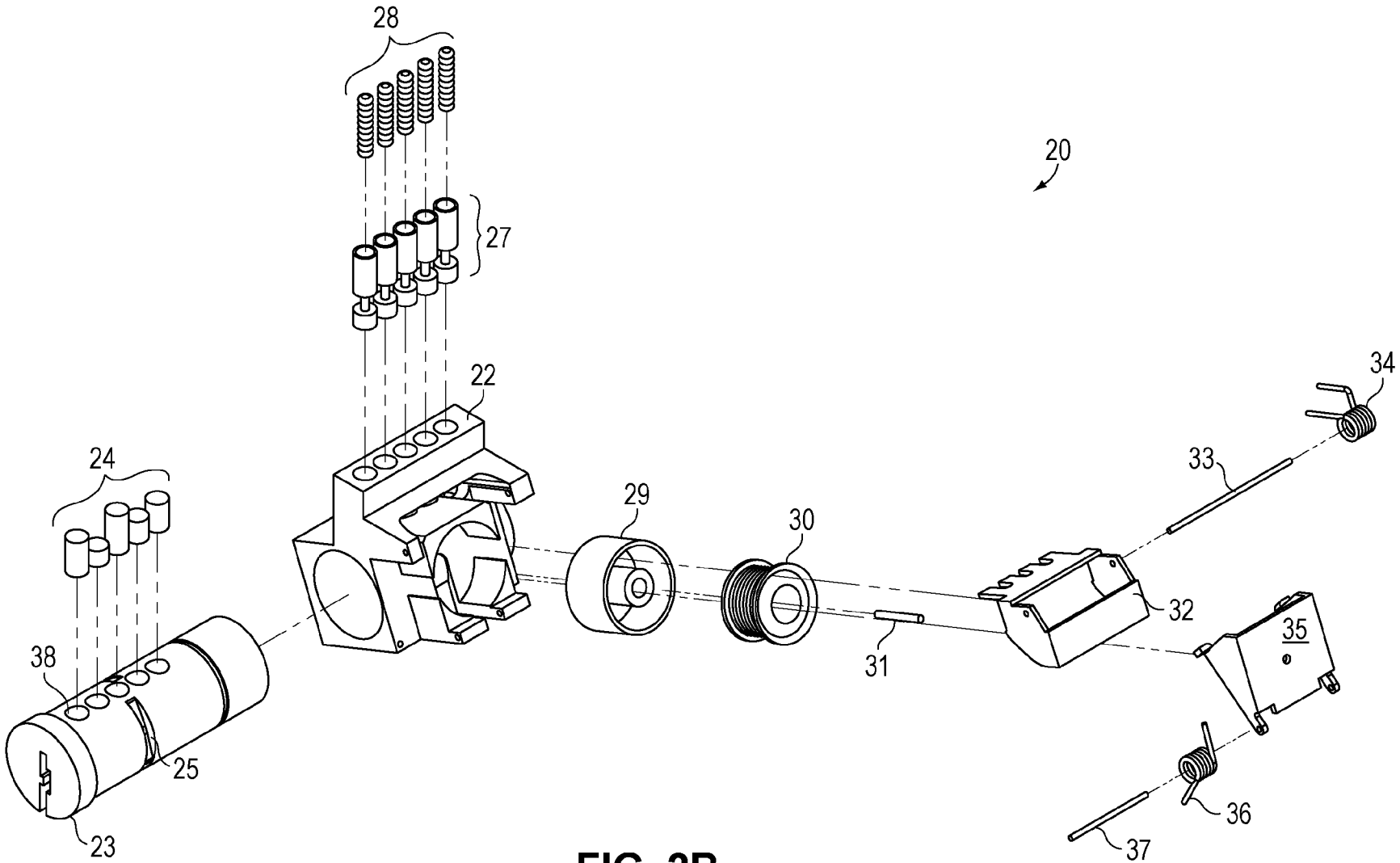
Figure 2C:
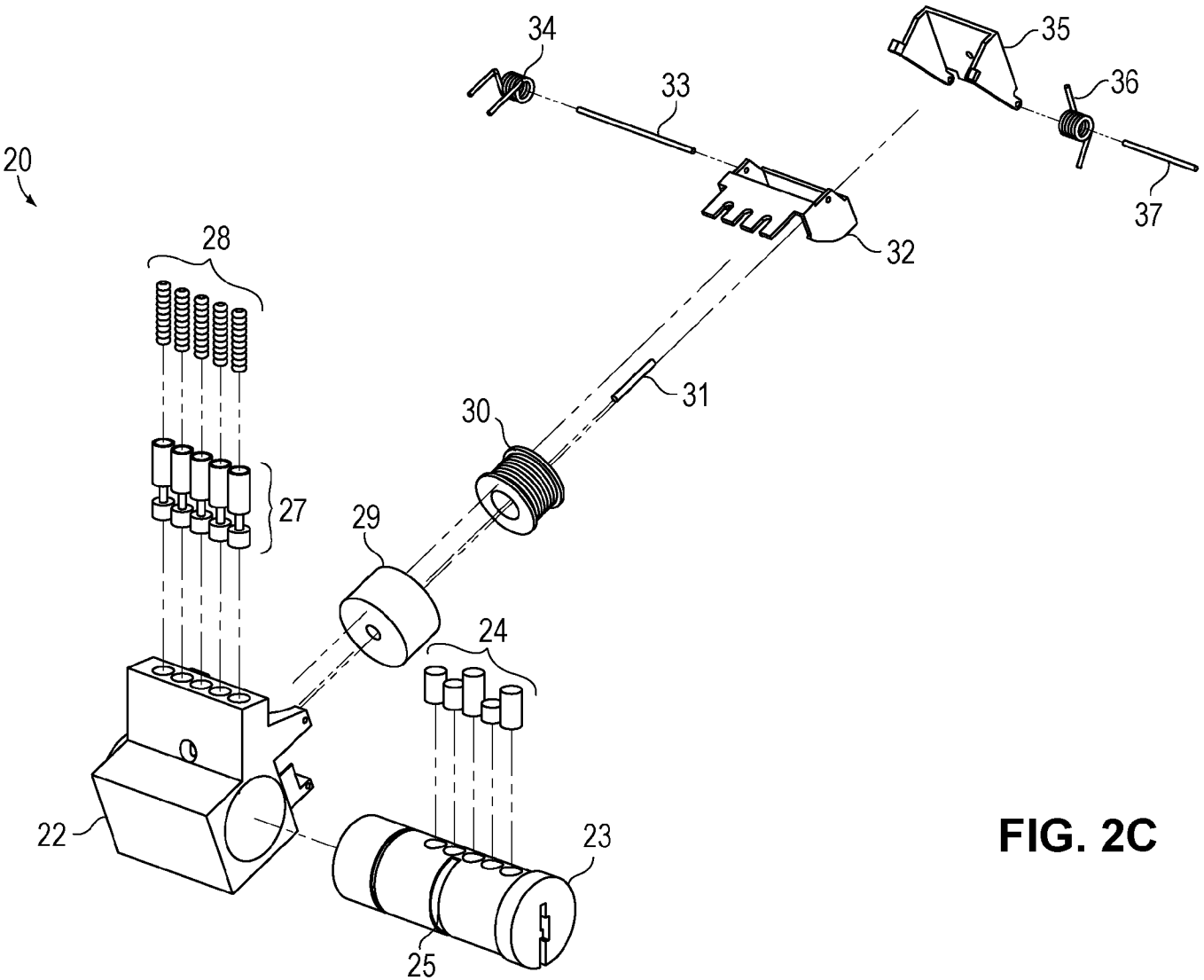
Figure 3A:
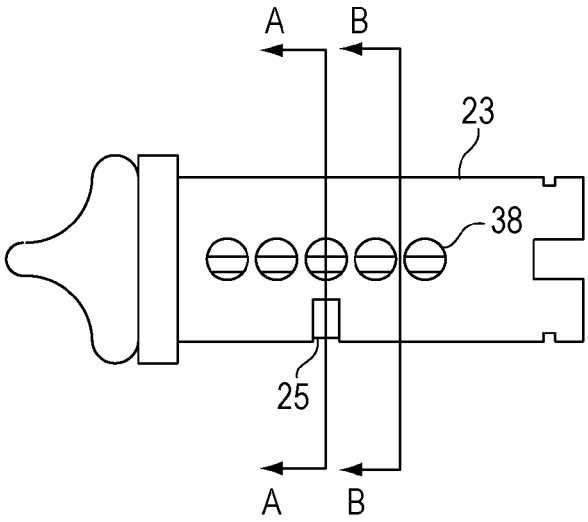
FIGS. 3A and 3B are the top and bottom views of the lock cylinder according to one embodiment of the present invention.
Figure 3B:
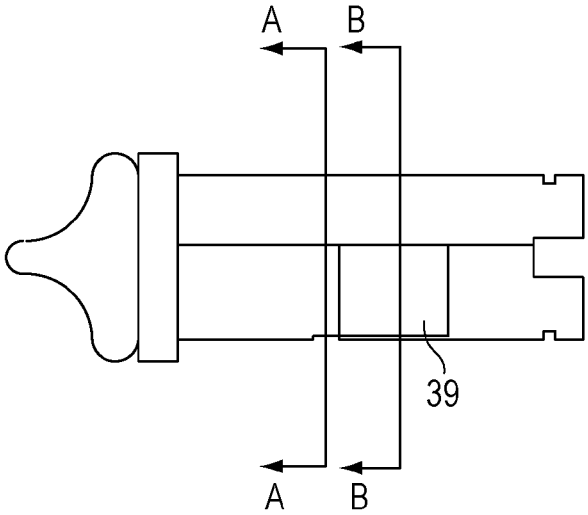
Figure 3C:
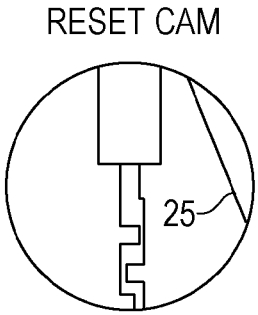
FIG. 3C is the cross-sectional view of the lock cylinder across the line A showing the reset cam path according to one embodiment of the present invention.
Figure 3D:
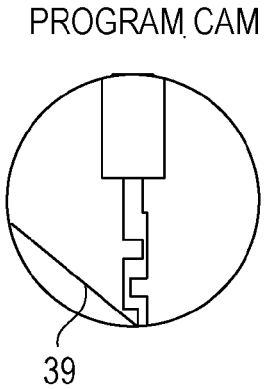
FIG. 3D is the cross-sectional view of the lock cylinder across the line B showing the program cam path according to one embodiment of the present invention.
Figure 4B:
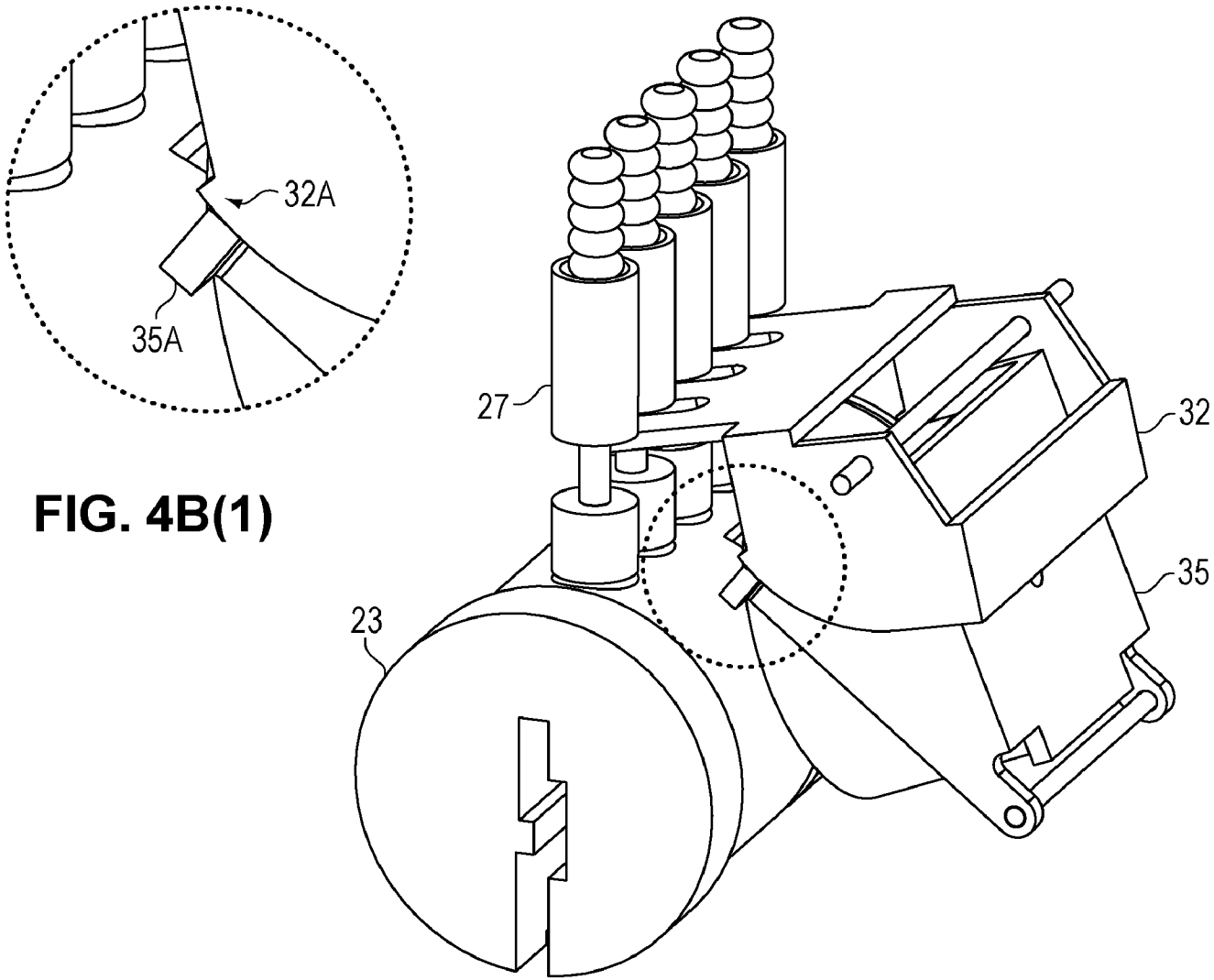
Figure 5A:
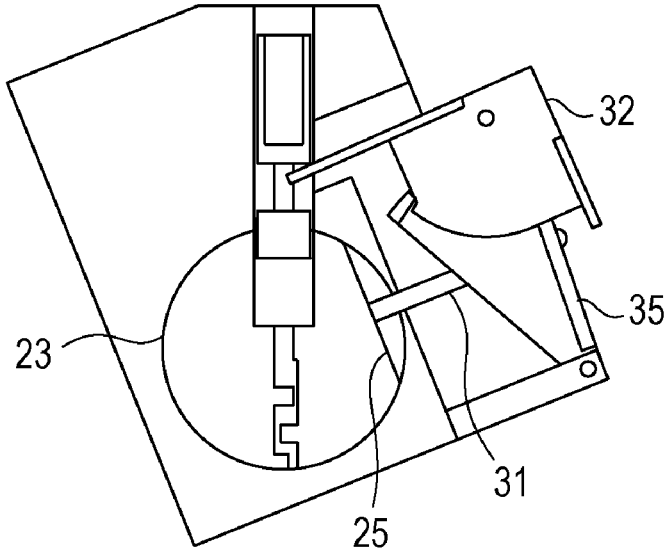
FIGS. 5A-5B are cross-sectional views of the lock assembly illustrating the latch reset operation according to one embodiment of the present invention.
Figure 5B:
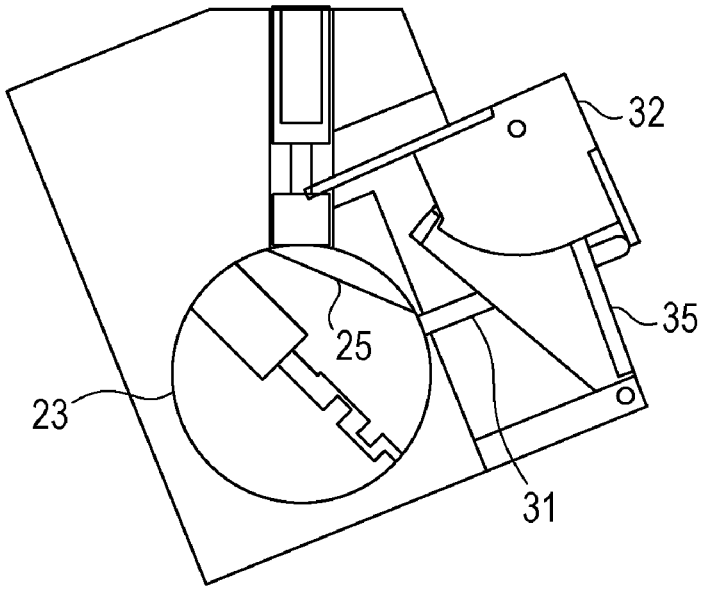
Figure 6A:
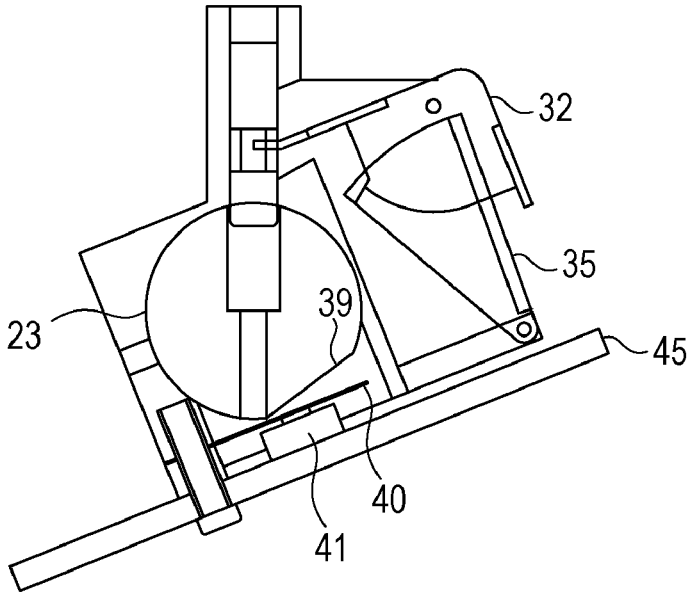
FIGS. 6A-6B are cross-sectional views of the lock assembly illustrating the code programming operation according to one embodiment of the present invention.
Figure 6B:
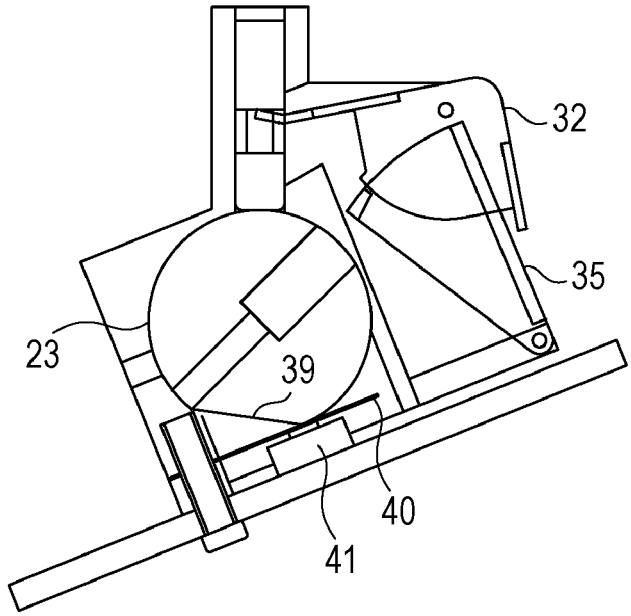

The construction of the lock assembly will now be described with reference to the following figures. FIGS. 2A-2C are the isometric and exploded views of the lock assembly of the electronic combination lock according to one embodiment of the present invention. FIGS. 3A and 3B are the top and bottom views of the lock cylinder according to one embodiment of the present invention. FIG. 3C is the cross-sectional view of the lock cylinder across the line A showing the reset cam path according to one embodiment of the present invention. FIG. 3D is the cross-sectional view of the lock cylinder across the line B showing the program cam path according to one embodiment of the present invention. FIGS. 4A and 4B illustrate the configuration of the lift comb and the latch in the latched and unlatched positions according to one embodiment of the present invention. FIGS. 5A-5B are cross-sectional views of the lock assembly illustrating the latch reset operation according to one embodiment of the present invention. FIGS. 6A-6B are cross-sectional views of the lock assembly illustrating the code programming operation according to one embodiment of the present invention. The following description of the lock assembly will refer to all of the aforementioned figures.

A lock assembly 20 of the electronic combination lock of the present invention includes the following major components: a lock body or lock housing 22 including an axial opening for housing a rotating cylinder 23, a set of key pins 24 of variable length which matches a key associated with the lock, a set of lift lock pins 27 of the same length, a set of lift lock pin force spring 28, a lift comb 32, a latch 35, a latch reset pin 31, a latch torsion spring 36, a comb lift spring 34, and a code program reed 40. The cylinder 23 incorporates thereon a latch reset cam path 25 and a code programming cam path 39. The electrical component of the electronic combination lock, including the electrical circuit, a number switch actuated by the code entry button and a program switch actuated by the code programming cam path, and the batteries will be described in more detail below. The lock body 22 includes mounting surface for code program reed 40 and a printed circuit board 45 incorporating the electrical circuit.

In the present description, the lock assembly 20 includes a set of five key pins and a corresponding set of five lift lock pins and five force springs. The use of five key pins in the multi-pin cylinder lock in the present embodiment is illustrative only. The lock assembly of the present invention can be implemented using one or more key pins depending on the application. In some embodiments, the lock assembly may include a single key pin only. The construction of the lock assembly of the present invention applies to one or more key pins being used.

Referring to FIGS. 2A-2C, the lock body 22 includes vertical bores for accommodating the set of spring loaded lift lock pins 27 and the associated force springs 28. The lift lock pins 27 work in conjunction with the key pins 24 that reside in vertical bores 38 formed in the cylinder 23. When the lock assembly 20 is in the locked position, the set of key pins are resting against stops in the bores of the cylinder 23. The length of the key pins allows each of the lift lock pins to engage slightly in the bores of the cylinder 23 thereby locking the cylinder and preventing the cylinder from rotating in the lock body 22 because a major portion of the length of the spring loaded lift lock pins 27 resides in the cylinder.

When a key is inserted into the key slot 16 matching the pattern of the key pins, the key pins 24 raise from their stops so that their upper ends are tangent to the circumference of the cylinder 23. This action raises the spring loaded lift lock pins 27 out of their engagement with the cylinder 23, thereby allowing the cylinder to be rotated in relation to the lock body 22. The cylinder 23 is generally made of brass and the lock body 22 is made of a dissimilar metal to assure freedom of rotation of the cylinder. The force springs 28 mounted above the lift lock pins 27 assure that the lift lock pins are forced down into the bores of the cylinder by the force of the spring when the key is removed and the cylinder 23 is moved to a vertical position to enable removal of the key.

In the present embodiment, each of the lift lock pins 27 incorporates a groove to facilitate interaction with the lift comb 32 and a bore at the upper end of the pin for housing at least a portion of the force spring 28. The groove is positioned and dimensioned so that the fingers of the lift comb 32 are able to lift the lift lock pins yet the width (the vertical dimension) of the groove allows the lift lock pin to remain in a raised position even when the lift comb is reset down. The latch reset action, to be described in more detail below, occurs as the cylinder is rotated 90 degrees counter-clockwise. At this position, the lift lock pins 27 are resting against the circumference of the cylinder 23 and the lift lock pins cannot move downward into the bore of the cylinder until such time as the cylinder is returned to its vertical home position. The position of the cylinder 23 shown in FIG. 2A is referred to as the home position of the cylinder. The bore at the upper end of the lift lock pin houses the force spring to assure proper locking alignment of the lift lock pin in the vertical bores of the lock body 22.

The lift comb 32 has fingers that interact with the grooves of the lift lock pins 27 (see FIGS. 4A and 4B). When the latch 35 releases the lift comb 32, the comb lift spring 34 forces the lift comb to pivot about a rod 33. The pivotal motion of the comb lifts the lift lock pins 27 against the force of their respective force springs 28. As shown in FIG. 4B, as a result of the lifting action of the lift comb 32, the lift lock pins 27 are lifted out of the cylinder 23. Note that in FIGS. 4A and 4B, the comb lift spring and the latch torsion spring are not shown to simplify the drawing. The positions of the comb lift spring and the latch torsion spring in the key lock assembly are shown in FIG. 2A.

Referring still to FIGS. 4A and 4B, the lift comb 32 includes a notch 32A on at least one side of the comb. The notch 32A interacts with a finger 35A incorporated in the latch 35. The latch 35 is mounted on a rod 37 and is engaged by the latch torsion spring 36. Latch 35 is actuated by a magnetic coil 30 housed in a housing 29. The magnetic coil 30 is powered by the electrical circuit when the correct entry code is entered for unlocking the lock. In the locked position (FIG. 4A), the latch torsion spring 36 forces the latch 35 to be extended and engaging the notch 32A of the lift comb 32. In the unlock operation (FIG. 4B), the magnetic coil 30 ("the magnet") is activated and the magnetic action pulls on the latch 35. That is, the latch 35 is pulled towards the magnet 30 and the latch 35 pivots about rod 37 and retracts from the lift comb 32. The lift comb 32 is thereby released and the comb lift spring 34 acts to pivot the lift comb 32 for lifting the lift lock pins 32.

Referring to FIGS. 3A to 3D, the cylinder 23 of the lock assembly includes two cam paths which are formed as grooves in the circumference of the cylinder. The latch reset cam path 25 is provided at the side circumference of the cylinder to cam the latch reset pin 31 (FIG. 2B) outward when the cylinder is rotated 90 degrees during the unlocking and locking sequences. In the home position, the latch reset pin 31 rests against latch 35 and does not push on the latch (FIG. 5A). The groove forming the latch reset cam path 25 is such that when the cylinder 23 is rotated counter-clockwise, the latch reset pin 31 actuates at the 45 degree position (FIG. 5B) and when the cylinder 23 is rotated clockwise, the latch reset pin 31 actuates at the 90 degree position. The latch reset pin 31 which operates in conjunction with the latch reset cam path 25 serves to reset the latch and the lift comb to the lock position as shown in FIG. 4A. In this manner, the electronic combination lock can be reset to a locked position after the lock has been unlocked by the keyless unlocking mechanism.

The code programming cam path 39 is provided at the bottom circumference of the cylinder 23. Referring to FIGS. 6A and 6B, the code programming cam path 39 interacts with code program reed 40 which in turn actuates the program switch 41 when the cylinder is rotated. The reed 40 is used to isolate the push button of the program switch 41 from any sliding forces that could occur when the cylinder is rotated to activate the switch. In the code programming mode, the key inserted in the key slot and the cylinder is rotated counter-clockwise or clockwise up to 90 degrees to store the new code. At the home position, the code programming cam path 39 does not engage the code program reed 40 (FIG. 6A). When the cylinder is turned by the key, the code program cam path 39 pushes on the code program reed 40 (FIG. 6B) and the resulting actuation of the program switch 41 allows an entry code to be stored in the non-volatile memory of the electrical circuit.

Operation of the Lock Assembly

The operation of the lock assembly will now be described in detail with reference to FIGS. 7A-7D and FIGS. 8A-8D. FIGS. 7A-7D are the isometric and cross-sectional views of the lock assembly at different stages of unlock operation. FIGS. 8A-8D are the cross-sectional views of the lock assembly at different stages of the code programming operation. In the present figures, the latch torsion spring and the comb lift spring are not shown to simplify the drawings.

Figure 7A:
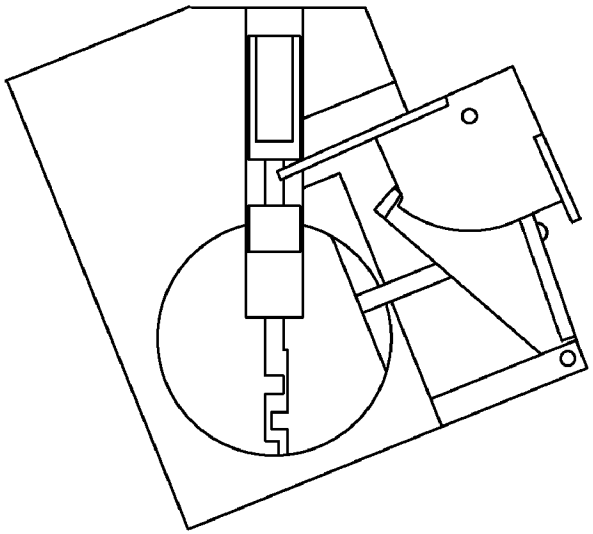
FIGS. 7A-7D are the isometric and cross-sectional views of the lock assembly at different stages of unlock operation.
Figure 7A:
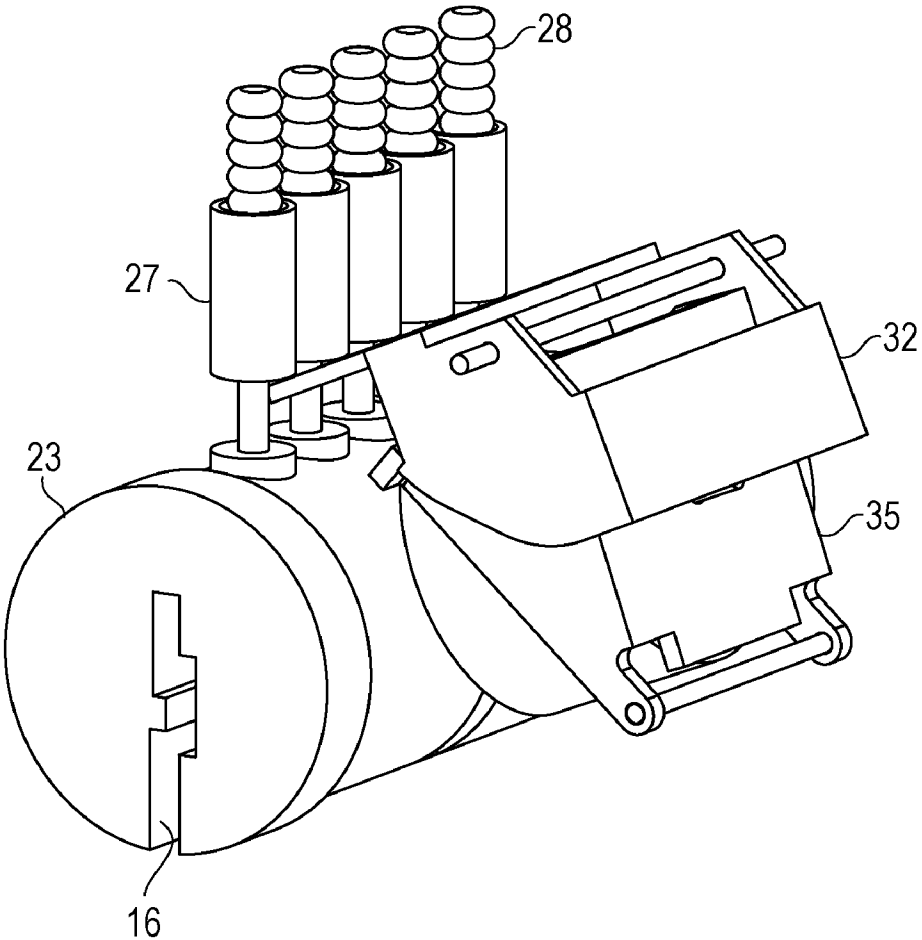

FIG. 7A illustrates the lock condition of lock assembly. The cylinder 23 is in the home position, that is, the key slot 16 is in the 12 o'clock position. The lift comb is latched by the latch in the down position. The lift lock pins are forced into the bores of cylinder 23 by the action of the lift lock pin force springs 28. The cylinder 23 cannot be turned and the lock assembly is in the lock state.

Figure 7B:
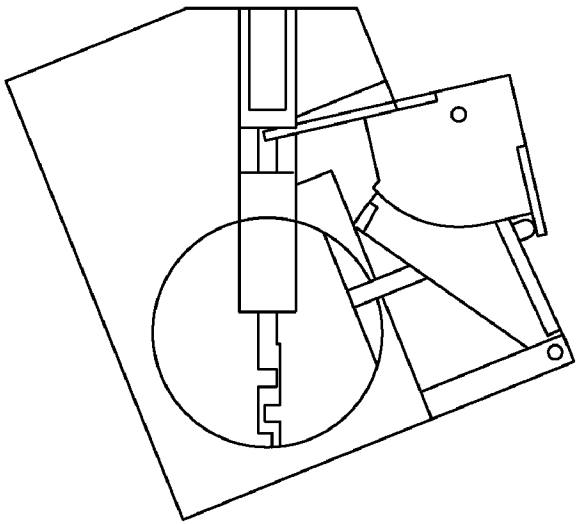
Figure 7B:
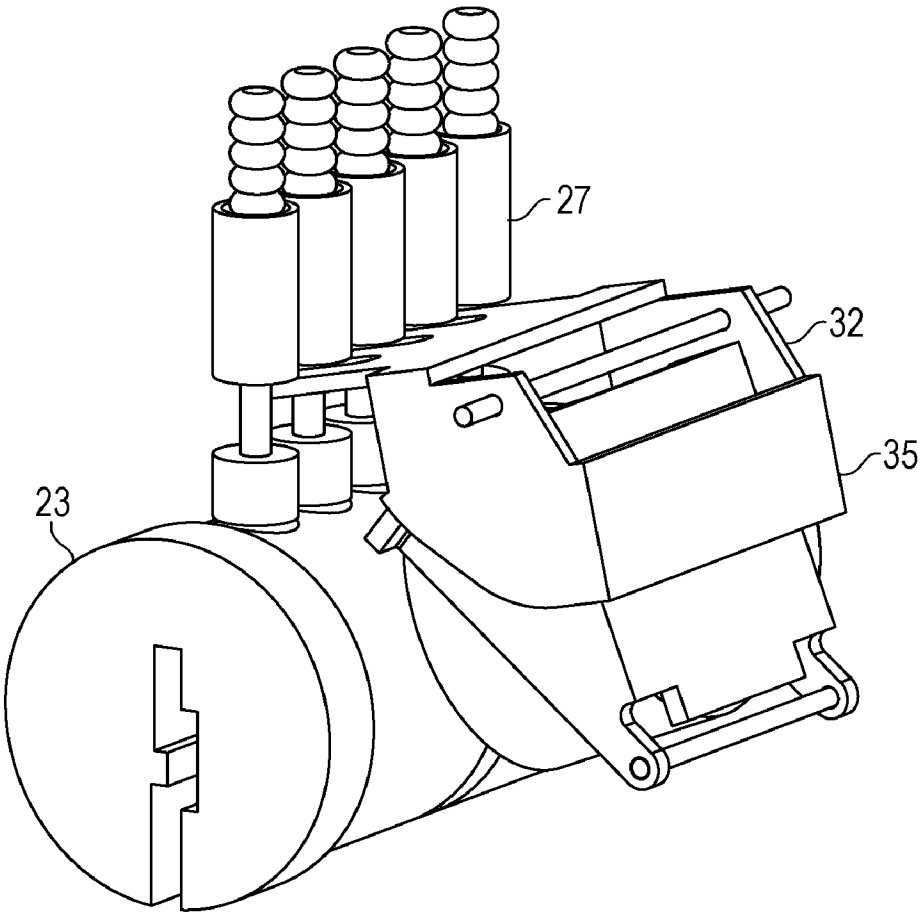

FIG. 7B illustrates a step in the unlocking operation of the lock assembly. To unlock the lock assembly without a key, the user enters the entry code via the code entry button which activates the electrical circuit. When the electrical circuit determines that the correct entry code has been entered, the magnet 30 is energized and pulls on the latch 35. The lift comb 32 is released and the comb lift spring forces the lift comb to pivot, thereby lifting the lift lock pins 27 out of the cylinder bores. The cylinder 23 is now free to be rotated in the lock body. In keyless unlocking operation, only the lift lock pins 27 are moved. The key pins in the cylinder are at rest within their bores in the cylinder.

Figure 7C:
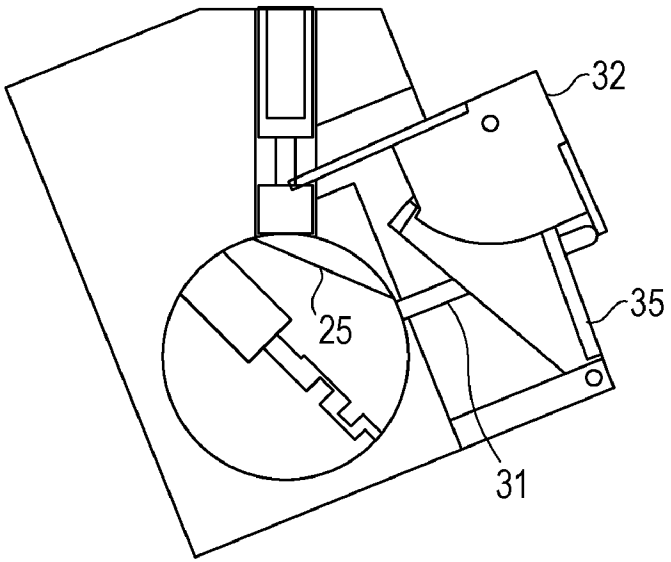
Figure 7C:
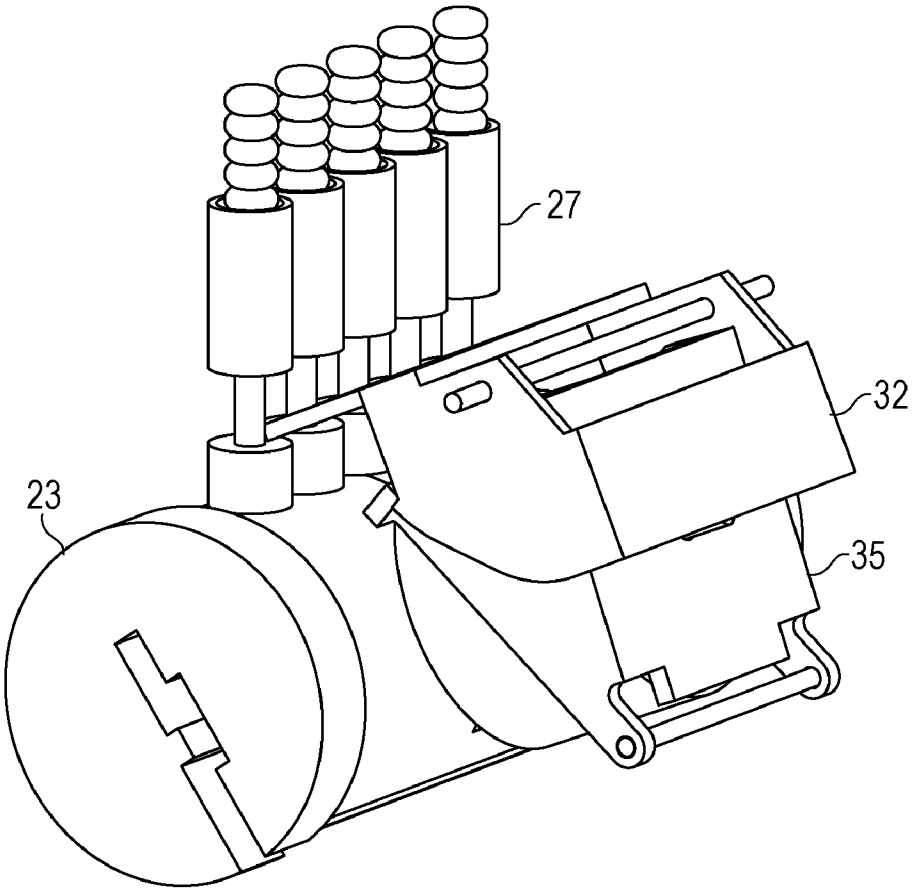

FIG. 7C illustrates the latch reset step in the unlocking operation of the lock assembly. Once the lift lock pins are lifted, the cylinder 23 is turned counter-clockwise to unlock the door latch locking mechanism. When the cylinder is rotated about 30-40 degrees counter-clockwise, the latch reset cam path 25 pushes on the latch reset pin 31 (See FIG. 7C(1)). The latch reset pin 31 pushes on the lift comb 32 to return the lift comb to the down position where the notch 32A of lift comb 32 engages the finger 35A of latch 35. The lift comb and latch are now reset. The length of the groove in the lift lock pins 27 is such that sufficient space is provided to allow the lift comb to drop down for latch reset. The lift lock pins 27 remain lifted out of the cylinder in this position because they are resting on the circumference of the cylinder. The cylinder remains free to turn and the lock assembly remains unlocked.

Figure 7D:
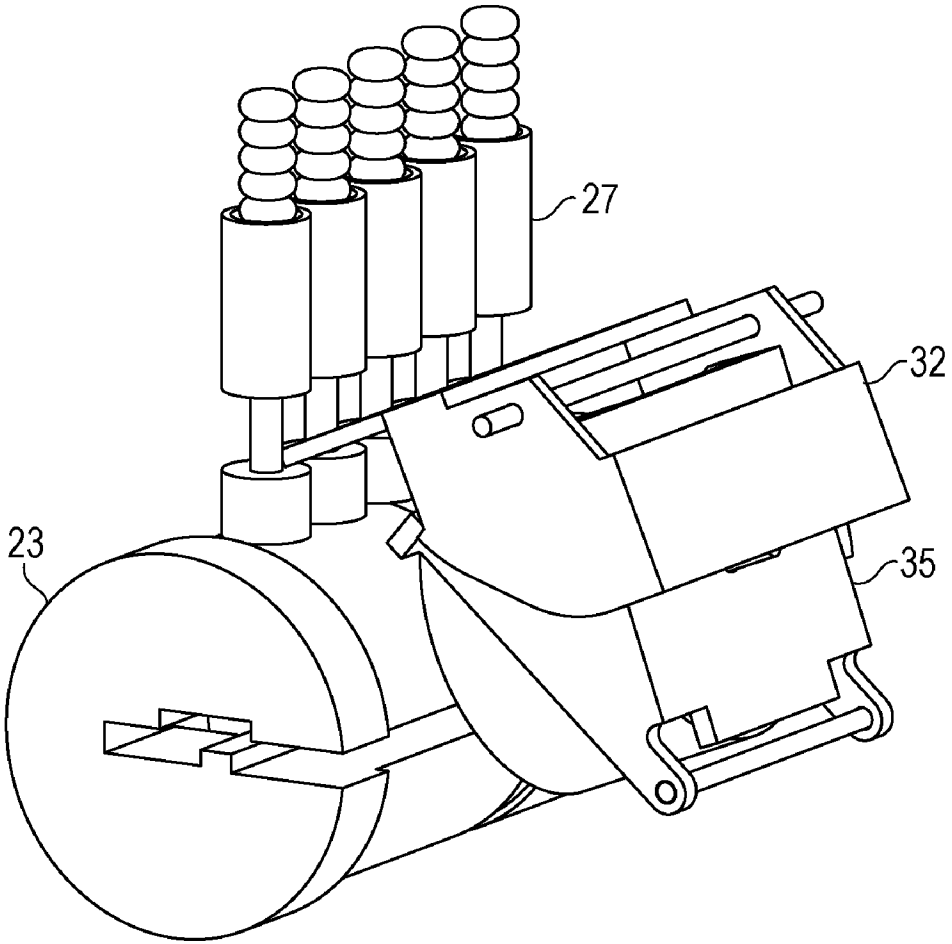

FIG. 7D illustrates the last step in the unlocking operation of the lock assembly. The cylinder 23 is rotated to 90 degrees counter-clockwise position. In a standard door lock, the rotation of cylinder 23 will cause the door latch locking mechanism to unlock so that the spring-driven door latch can be retracted by the door handle to allow the door to be opened. In the keyless operation, the rotation of the cylinder 23 in FIGS. 7C and 7D is accomplished using the turn button 12 (FIGS. 1A-1C). While the cylinder can be left at the 9 O'clock position in the unlock state, in most cases, the user turns the cylinder back to the home position to prepare the external door handle for future use.

Once unlocked, the electronic combination lock of the present invention can be locked using the internal door handle as is conventionally done. The internal door handle includes a turn knob which is rotated counter-clockwise when viewed from the internal door handle. The action of the internal knob rotates the cylinder of the external door knob back to the vertical or home position and the lift lock pins drop down into the bores of the cylinder. The lift comb and latch were already reset during the unlock operation described above. The cylinder is now locked. Furthermore, the counter-clockwise rotation of the lock cylinder causes the door latch locking mechanism to be engaged to lock the spring-driven door latch so that the door latch can no longer be retracted.

Once unlocked, the electronic combination lock of the present invention can also be locked using the external door handle. To lock the lock assembly, the entry code is entered to lift the lift lock pins. The cylinder is turned 90 degrees clockwise to engage the door latch locking mechanism and then the cylinder is turned 90 degrees counter-clockwise back to home position. In some cases, due to the design of the multi-pin lock mechanism, it may be necessary to turn the cylinder 90° clockwise to reposition the internal door handle to its horizontal position for resetting the door latch locking mechanism. The lock is now locked and remains in the lock state.

In one embodiment, the latch reset cam path operates to push on the latch reset pin when the cylinder is turned 90° clockwise. Even though the lift comb and latch were reset already during the unlock operation, the lift comb and latch are reset again just to make sure that the lift lock pins are allowed to drop down into the bores of the cylinder.

Figure 8A:
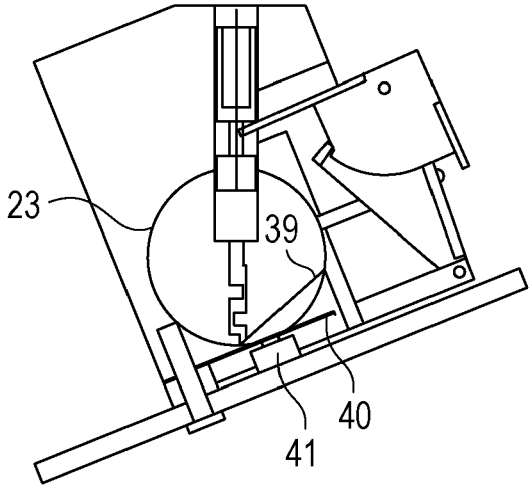
FIGS. 8A-8D are the cross-sectional views of the lock assembly at different stages of the code programming operation.
Figure 8B:
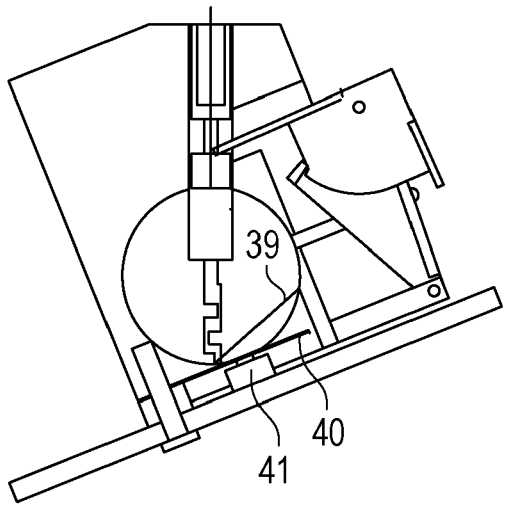

The code programming operation of the electronic combination lock of the present invention will now be described. Referring to FIG. 8A, the lock assembly is in its home position and the cylinder is locked. The code programming cam path 39 does not engage the code program reed 40 and the code program reed 40 does not press on the program switch 41. When programming of a new entry code is desired, the new entry code is entered using the code entry button and the key is inserted into the cylinder to lift the lift lock pins out of the cylinder (FIG. 8B). The cylinder is now ready to be rotated under the influence of the key. The order of new code entry and insertion of the key is not critical. Thus, a user may insert the key first and then enter the new code.

After the new code is entered and the key is inserted, the cylinder is rotated clockwise using the key from its home position to the cylinder stop at about 90 degrees. At about 55 degrees (FIG. 8C), as a result of the rotation, the code programming cam path 39 pushes on the reed 40 and the reed engages the program switch 41. The electrical circuit thus detects one actuation of the program switch. Then, still using the key, the cylinder is rotated counter-clockwise past the home position to the cylinder stop at 90 degrees. At about 25 degrees counter-clockwise from vertical (FIG. 8D), as a result of this second rotation, a second actuation of the program switch 41 is realized by the code programming cam path 39 pressing on the code program reed 40. The two actuations of the program switch must occur within a predetermined time, e.g. within 4 seconds.

In the present embodiment, the cylinder is turned clockwise first and then counter-clockwise to obtain the two actuations of the program switch required to store the input code. In other embodiments, the cylinder can be turned counter-clockwise first and the clockwise. The turn direction of the cylinder is not critical to the practice of the present invention as long as two actuations of the program switch are made.

In the present embodiment, two actuations of the program switch are required for the electrical circuit to complete the code programming operation. When two actuations of the program switch are detected within the predetermined time duration by the electrical circuit, the previously stored code will be erased and the input code just now entered will be stored in the integrated circuit as the new entry code. In other embodiments, one or more actuations of the program switch are used to activate the programming mode. The actuation of the program switch can be realized by turning the cylinder using the key in the clockwise or counter-clockwise direction to allow the code programming cam path to interact with the code program reed. In the present embodiment, using two program switch actuations has the advantage of preventing inadvertent entry of a new code while minimizing the number of turns required.

Electrical Circuit

Figure 9:
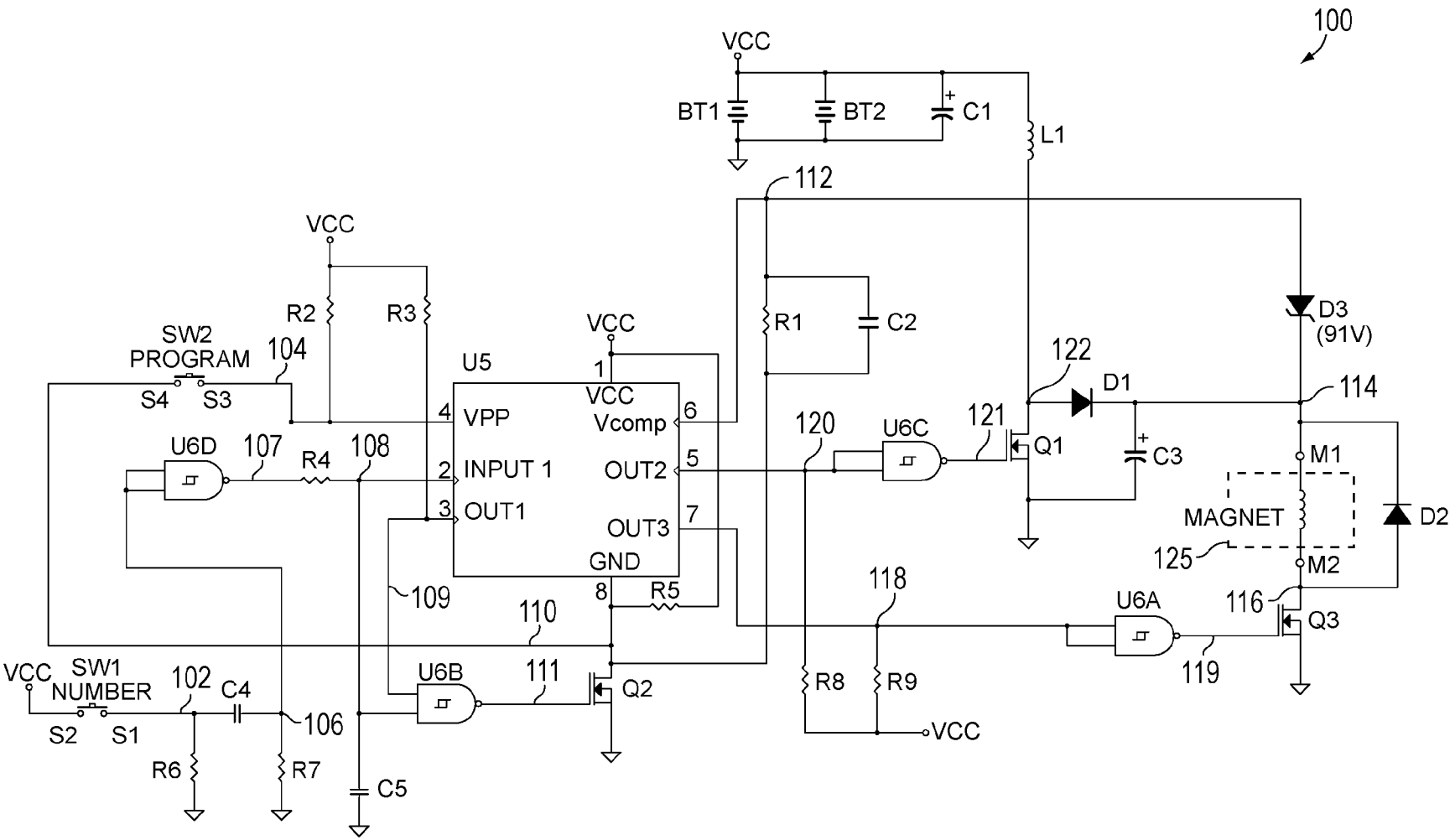
FIG. 9 is a circuit diagram of an electrical circuit for operating the lock assembly according to one embodiment of the present invention.

The electrical circuit for controlling the operation of the lock assembly in the electronic combination lock of the present invention will now be described. FIG. 9 is a circuit diagram of an electrical circuit for operating the lock assembly according to one embodiment of the present invention. Referring to FIG. 9, the main functional blocks of electrical circuit 100 includes a microprocessor, logic circuitry for code entry and code programming, a conditioning circuit for the number switch and a voltage boost circuit for charging the magnet for engaging the latch. Electrical circuit 100 receives two input signals. The first input signal is the number signal generated at a first input node 102 when the number switch (SW1) is actuated. The second input signal is the program signal generated at a second input node 104 when the program switch (SW2) is actuated. Switches SW1 and SW2 in FIG. 9 are the electrical representation of the number switch and the program switch in the lock assembly described above. As described above, the number switch is actuated by tapping of the number button while the program switch is actuated by the code program cam path on the cylinder.

Electrical circuit 100 has two operation modes—a code programming mode and a code entry mode. In the code programming mode, the program switch in the lock assembly is actuated one or more times within a predetermined time interval and the digital code entered via the number switch is stored in a non-volatile memory of the microprocessor. In the code entry mode, the input digital code is received and compared with the stored entry code. Meanwhile, the capacitor C3 is being charged up so that when the correct entry code is entered, the magnet is energized to retract the latch to release the comb, allowing the lock to be unlocked.

In the electronic combination lock of the present invention, a single code entry button is used for both code entry and for code programming. When a key is inserted in the key slot 16 and the lock cylinder is turned, the code program reed actuates a program switch in the electrical circuit. The input code that has been entered via a number switch actuated by the code entry button is stored as a new entry code. When the code entry button is pressed without actuation of the program switch, the code entry button actuates the number switch in the electrical circuit for activating the keyless unlocking operation mechanism.

In the present embodiment, electrical circuit 100 is powered by two batteries BT1, BT2 connected in parallel providing a power supply VCC voltage to the electrical circuit. In other embodiments, other battery arrangements can be used as long as sufficient power is provided to the electrical circuit to support the circuit operation, including charging up a sufficiently high voltage for the magnet. Electrical circuit 100, including the batteries, is built entirely on a printed circuit board which can be fit into the door handle together with the lock assembly described above, forming the electrical combination lock of the present invention.

Code Entry and Code Programming

As described above, the entry code, for access or for programming, is entered into the electrical circuit by tapping of the code entry button. Tapping of the code entry button actuates the number switch (SW1). When the number switch (SW1) is actuated, the switch electrically shorts the two switch terminals S1 and S2 together. In the present embodiment, the first switch terminal (S1) is the first input node (102) of electrical circuit 100 while the second switch terminal (S2) is connected to the power supply Vcc voltage. Thus, whenever the number switch SW1 is closed, the first input node (102) is shorted to the VCC voltage.

In the present embodiment, electrical circuit 100 is powered off when not in use. However, the very first tap of the code entry button powers up the electrical circuit while the remaining taps corresponding to the digits of the input code, whether the entry code or the code to be programmed, are continued to be entered following the first tap in a normal fashion. The power up operation of the electrical circuit is very fast and is transparent to the user of the electronic combination lock.

Assume that the entry code has been programmed to "32416" and "O" represents a momentary tap or actuation of the number switch SW1. The "32416" entry code is entered into the electrical circuit as sequential taps as follows: OOO pause OO pause OOOO pause O pause OOOOOO, where the very first tap initiates the power up process of the electrical circuit. A pause has a time duration from 0.4 to 4 seconds whereas the sequential taps are spaced apart from 0.05 to 0.3 seconds. In other embodiments, the pause in the code entry sequence can be eliminated by the use of a third switch as an ENTER switch, as will be described in more detail below.

Figure 8C:
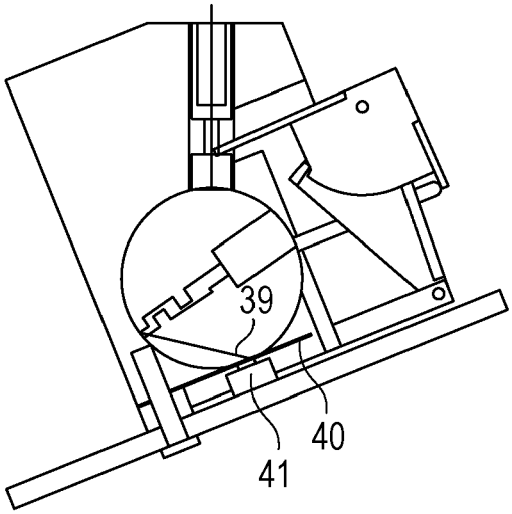
Figure 8D:
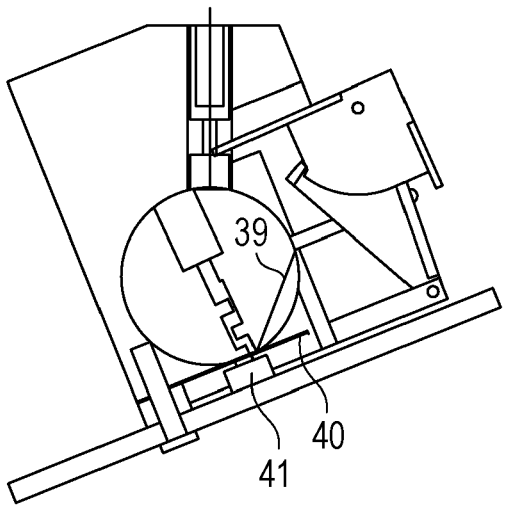

In the code programming mode, the entry code entered through the code entry button is stored in the microprocessor. To program a new entry code, the new code is entered via the code entry button in the same manner as described above with reference to entering of the entry code for access. That is, the new entry code is entered as sequential taps representing the desired new entry code digits with pauses in between each digit. Before or just after the new code is entered, the key is inserted into the key slot to lift the pins (FIG. 8B). With the key inserted in the key slot and the new code entered, the cylinder is turned clockwise using the key usually until the cylinder reaches the cylinder stop at 90° from home position. At a rotation of about 55° clockwise from home position, the program switch (SW2) is actuated, as shown in FIG. 8C. This results in the first actuation of the program switch. Then, the cylinder is turned counter-clockwise until the cylinder reaches the cylinder stop at 90° from home position. At a rotation of about 25° counter-clockwise from home position, the program switch (SW2) is actuated a second time, as shown in FIG. 8D. Then, the cylinder is returned to the home position and the key is removed (FIG. 8A). There is a time allowance of 4 seconds from the code entry to the completion of the clockwise and counter-clockwise cylinder rotations. By entering a entry code, inserting the key, and turning the cylinder clockwise and counter-clockwise, the new entry code is stored in the non-volatile memory of the microprocessor.

When the program switch (SW2) is actuated, the switch electrically shorts the two switch terminals S3 and S4 together. In the present embodiment, the first switch terminal (S3) is the second input node (104) of electrical circuit 100 while the second switch terminal (S4) is connected to node 110 which is the ground terminal of the microprocessor. After the first tap of the code entry button, the ground terminal (node 110) of the microprocessor is shorted to the Vss or ground voltage. Therefore, whenever the program switch SW2 is closed, the second input node (104) is shorted to the ground or Vss voltage.

In the code entry mode, no key is required and the entry code is entered via the code entry button. The input code is compared with the stored program code. When the correct code is entered, the electrical circuit energize the magnet and the lock assembly activates to unlock the lock.

Microprocessor

Electrical circuit 100 includes a microprocessor U5 for controlling the operation of the electrical circuit. In the present embodiment, microprocessor U5 is implemented using a microcontroller that includes a CPU, non-volatile memories (such as Flash or EEPROM) and an analog voltage comparator. The non-volatile memory of microprocessor U5 is used to store the entry code. Furthermore, in the present embodiment, the microcontroller includes other features such as an internal voltage reference of 1.25V, a pulse-width modulation (PWM) circuit, an internal reset circuit, and an internal oscillator. The memories include RAM, Flash and EEPROM. In one embodiment, the entry code is stored in the EEPROM of the microcontroller. By using a microcontroller with integrated memory and comparator functions, fewer discrete components are required to implement the electrical circuit, resulting in space and cost saving. In one embodiment, microprocessor U5 is implemented using an 8-pin flash-based, 8-bit CMOS microcontroller (Part Number PIC12F683, available from Microchip Technology Inc., Chandler, Ariz.). In other embodiments, other types of microprocessors can be used and non-volatile memories and/or analog comparators external to the microprocessor can also be used to implement the functions of microprocessor U5.

In one embodiment, microprocessor U5 operates at a high frequency to allow the microprocessor to finish all timing and housekeeping functions after the first tap of the code entry button and well before the second tap. In the present embodiment, microprocessor U5 has an internal frequency of 8 MHz and the microprocessor U5 can finish all timing and housekeeping functions within 1/1000th second, well short of the time between the first and second taps of the code entry button.

Electrical circuit 100 is configured to enable the programming of an entry code having N number of digits. The limitation on the number of digits for the entry code is the size of the non-volatile memory that is provided in microprocessor U5. In one embodiment, the entry code is a string of non-zero numbers up to 6 digits. For example, "999999", represents the largest value that can be programmed into electrical circuit 100.

Logic Circuitry and Conditioning Circuit

The logic circuitry in electrical circuit 100 supports the code entry function, the code programming function, the voltage boost operation and the magnet actuation operation. The logic circuitry of electrical circuit 100 includes logic gates U6A to U6D, transistors Q2 and Q3 and passive components such as resistors and capacitors. In the present embodiment, logic gates U6A to U6D are implemented using 2-input NAND Schmitt Triggers.

One feature of the electronic combination lock of the present invention is that the lock consumes no power when it is idle or not being used. The reason is that the ground terminal (pin 8) of the microprocessor is connected to node 110 which is switchably connected to the ground voltage. Referring to FIG. 9, node 110 is connected to the ground voltage through NMOS transistor Q2. When the lock is idle, transistor Q2 is turned off and node 110 is pulled up to the power supply Vcc voltage through resistor R5. The microprocessor U5 and the associated circuitry in electrical circuit 100 are thus powered off and no power is consumed.

The power up operation of electrical circuit 100 will now be described with reference to the circuit diagram in FIG. 9 and the timing diagram in FIG. 10. After the first tap or first actuation of the number switch S1 is detected, first input node 102 goes from a logical low state to a logical high state (e.g., from 0V to the Vcc voltage). The first input signal (waveform 152) at the first input node 102 may have a few glitches or ground bounces before settling into the logical high state. Electrical circuit 100 includes a conditioning circuit for the first input signal generated by the number switch SW1.

The conditioning circuit for the first input signal includes resistors R6 and R7 and capacitor C4 to generate an RC decay based on the first input signal and resistor R4 and capacitor C5 for filtering the conditioned signal. The conditioning circuit is included to ensure that in the event that the code entry button is stuck and the number switch SW1 is permanently engaged, the electrical circuit will still shut off so as not to run down the battery. In operation, the conditioning circuit of resistors R6, R7 and capacitor C4 convert each actuation of the number switch SW1 into a pulse. Therefore, even when the number switch is stuck on, electrical circuit 100 will still time out after the predetermined time-out period (e.g., four seconds).

The first input node at node 102 is coupled to resistor R6, connected to ground, and capacitor C4, connected between nodes 102 and 106. Resistor R7 is connected between node 106 and ground. The circuit arrangement of resistors R6, R7 and capacitor C4 introduces a RC time delay to cause the input signal to decay towards ground until a subsequent rising edge is detected at the first input node. The first input signal after conditioning (node 106) is shown as waveform 154 in FIG. 10. Even when the first input node 102 is stuck at the Vcc voltage, the conditioned input signal will still decay to the ground voltage due to the action of the conditioning circuit. In this manner, when the code entry button becomes stuck, the battery power is preserved and the lock can be operational after the button is unstuck.

The conditioned input signal (node 106) is coupled to both inputs of NAND gate U6D. NAND gate U6D is thus functioning as an inverter. The output signal (node 107) from NAND gate U6D is a logical low pulse (waveform 156 in FIG. 10) corresponding to a rising edge of the first input signal which results from a single actuation of the number switch SW1. The output signal of NAND gate U6D is coupled to a low pass filter formed by resistor R4 and capacitor C5. The low pass filter operates to smooth out the input signal waveform and to remove the ground bounces on the conditioned first input signal. As a result, an input pulse (waveform 158) having no ground bounces is generated at a node 108. The input pulse is coupled to microprocessor U5 as the input signal INPUT1. Each depression or actuation of the number switch detected at node 102 will cause an input pulse (waveform 158) to be generated.

The input pulse generated at node 108 is also fed as one of the input to NAND gate U6B. When NAND gate U6B detects the low going pulse, the output signal (node 111) of NAND gate U6B will go high (waveform 160). The output signal (node 111) of NAND gate U6B drives the control terminal of NMOS transistor Q2. Therefore, when the output signal (node 111) of NAND gate U6B goes high, transistor Q2 is turned on and the ground terminal (node 110) of microprocessor U5 is shorted to ground and the microprocessor is thus powered up and turned on. When transistor Q2 is turned on, the switch terminal S4 of the program switch SW2 is grounded and the bottom terminal of resistor R1 and capacitor C2 are also grounded.

Figure 10:
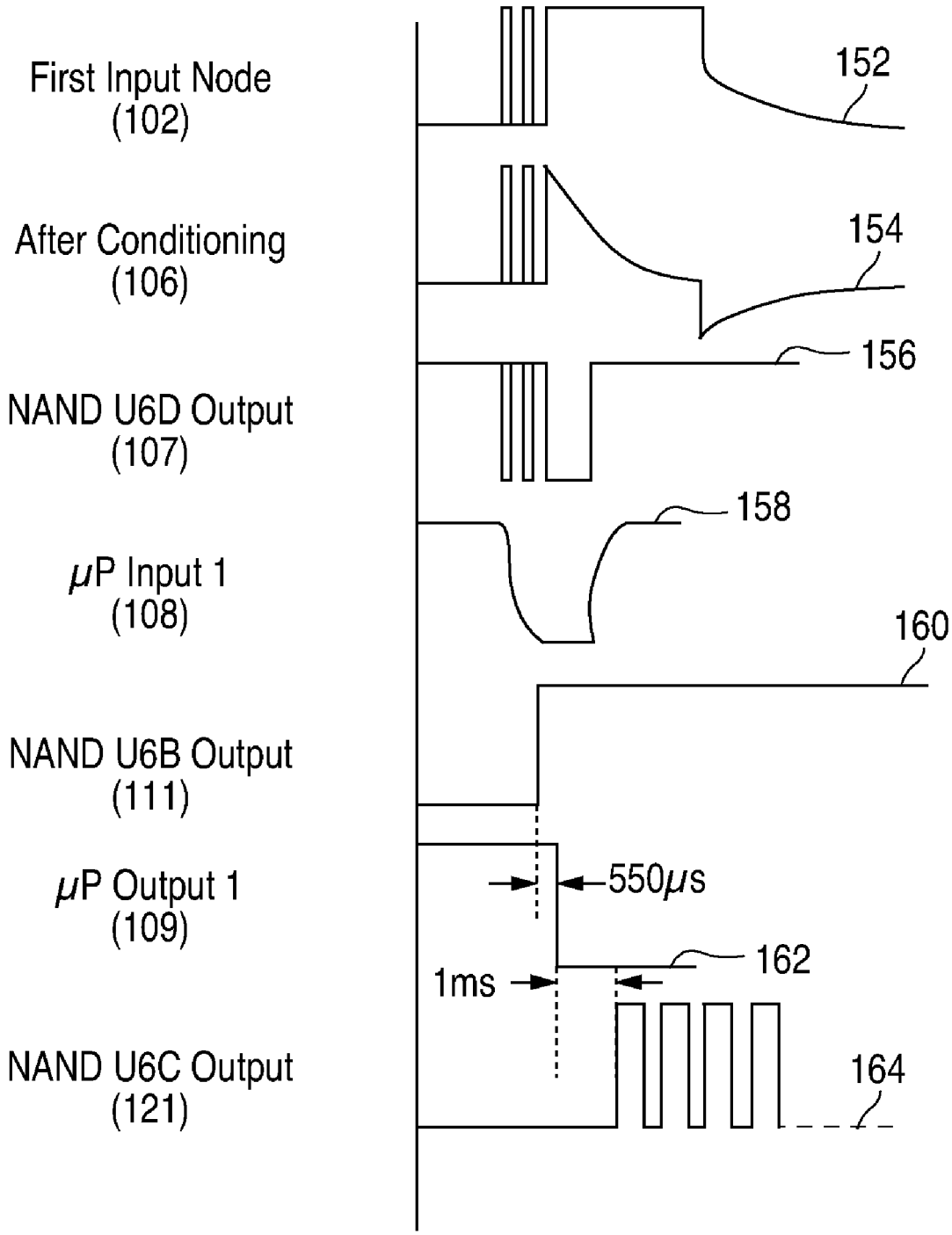
FIG. 10 is a timing diagram illustrating the signal waveforms at various nodes of the electrical circuit of FIG. 9.

After microprocessor U5 is turned on, the output signal OUT1 (node 109) of the microprocessor is asserted (going low) (waveform 162 of FIG. 10). The output signal OUT1 (node 109) is coupled to the other input terminal of NAND gate U6B to latch the logical high output of the NAND gate U6B. In this manner, transistor Q2 is kept on even after the expiration of the input pulse (node 108). As shown in FIG. 10, the input pulse at node 108 first causes transistor Q2 to turn on but the input pulse will return to the logical high state after a certain time period. A short time period (such as 550 μs) after the rising edge of the output signal (node 111) of NAND gate U6B, microprocessor U5 asserts the OUT1 signal (going low) so that the output signal (node 111) of NAND gate U6B is latched at a logical high state even when the input pulse (node 108) goes back up to a logical high.

The power up operation of electrical circuit 100 has to occur quickly after the first tap of the code entry button and prior to the next taps of the code entry button. In practice, the microcontroller U5 in electrical circuit 100 is able to power up and complete all its housekeeping tasks shortly after the first tap of the code entry button and long before the second tap is made, no matter how fast the second tap is made by the user. Therefore, the power up process of the electrical circuit is completely transparent to the user of the electronic combination lock of the present invention. Resistors R2 and R3 are passive pull up resistors to pull-up the voltage at the respective nodes 104 and 109 to the Vcc voltage when the nodes are not driven. In the present embodiment, all output signals of microprocessor U5 are pulled high after power-on reset by pull up resistors and the output signals are thus active low.

Boost Circuit

Electrical circuit 100 also includes a voltage boost circuit for generating the charging voltage for the magnet 125. The construction and operation of the voltage boost circuit are as follows. Resistor R1 and capacitor C2, NAND gate U6C connected as an inverter and NMOS transistor Q1, diodes D1 and D3, capacitor C3 and inductor L1 form the voltage boost circuit for boosting the voltage on capacitor C3. The voltage on capacitor C3 (node 114) is charged up to a high voltage value (e.g. 90V) so that when magnet 125 is activated, the high voltage on capacitor C3 will cause sufficient current to flow in magnet 125 to generate the desired magnetic flux. Accordingly, magnet 125 can be activated quickly and with sufficient magnetic flux to retract the latch once the correct entry code has been entered.

After the microprocessor U5 is turned on, microprocessor U5 generates an output signal OUT2 in the form of a pulse train (node 120). The output signal OUT2 is normally pulled up to the power supply Vcc voltage by passive pull up resistors R8. Thus, microprocessor U5 generates a pulse train on output signal OUT2 having negative-going (or low-going) pulses. The pulse train is buffered by NAND gate U6C functioning as an inverter. Thus, at the output node 121 of NAND gate U6C, a positive-going (high-going) pulse train is generated (waveform 164 of FIG. 10). In the present embodiment, the pulse train of output signal OUT2 is generated about 1 ms after the assertion (low transition) of the output signal OUT1.

The pulse train (node 121) drives the gate terminal of NMOS transistor Q1. Inductor L1 is connected between the power supply Vcc voltage and the drain terminal (node 122) of transistor Q1. The voltage boost circuit formed by inductor L1, diode D1, capacitor C3 and transistor Q1 converts the current source of the batteries into a voltage source on capacitor C3. By the pulsing action of transistor Q1, current is allowed to build up in inductor L1 and the voltage at capacitor C3 is thereby charged up to a desired level (such as 91 volts).

More specifically, diode D1 is connected between inductor L1 and capacitor C3 (i.e., between nodes 122 and 114) to ensure that current only flows from inductor L1 to capacitor C3 and not in reverse. In the present embodiment, the top plate (node 114) of capacitor C3 is charged up to 91V. Node 114 is coupled to one terminal M1 of magnet 125 to provide the boost voltage to the magnet when needed. Diode D2 is a clamping diode for clamping the voltage at the drain terminal of transistor Q3 (node 116) to a predetermined level. More specifically, diode D2 clamps the voltage at node 116 to a level that is one forward diode voltage drop above the voltage on capacitor C3. In this manner, transistor Q3 is protected from being destroyed by voltage spikes that may appear at node 116 when transistor Q3 is turned off.

The boost voltage at capacitor C3 is monitored and controlled by diode D3, resistor R1 and capacitor C2. Diode D3 is a 91V zener diode and has its anode terminal (node 112) connected to the comparator input voltage Vcomp of microprocessor U5 and its cathode terminal connected to the boost voltage (node 114) of capacitor C3. Microprocessor U5 includes an analog comparator comparing the comparator input voltage Vcomp to an internal reference voltage, such as 1.23V. When the voltage at the cathode terminal (node 114) exceeds 91V, diode D3 enters zener breakdown and current begins to flow through zener diode D3. This current generates a voltage across resistor R1 and capacitor C2, connected in parallel. The voltage at node 112 is fed to the comparator input voltage Vcomp terminal of microprocessor U5. When the voltage at node 112 reaches 1.23 volts, indicating that capacitor C3 has been fully charged up, microprocessor U5 will turn off the pulse train to stop the voltage boosting operation. After capacitor C3 is fully charged up, microprocessor U5 drives transistor Q1 in a trickle mode to maintain the voltage on capacitor C3. When the voltage on node 112 drops below 1.23V, the pulse train will again be generated to start the voltage boosting operation. In the trickle mode, the number of pulses sent to transistor Q1 is proportional to the voltage on capacitor C3. The monitoring and charging process repeat to keep the voltage across capacitor C3 at 91 volts. Thus, whenever the voltage at capacitor C3 falls below the reference voltage level, a few pulses are sent to transistor Q1 to draw currents through inductor L1 to charge up capacitor C3.

In the present embodiment, a high voltage of 91V is used at capacitor C3 because magnet 125 has a large number of turns. A large number of turns on the inductor forming the magnet is used to generate a sufficiently high magnetic flux for engaging the latch. Because of the large number of turns for the magnet, a high voltage is needed to supply the magnet with a high current pulse.

The magnet 125 is turned on when NMOS transistor Q3 is turned on. When an input code is entered and the program switch SW2 is not engaged, microprocessor U5 retrieves the stored entry code from its non-volatile memory. The input code is compared to the stored entry code. If the input code matches the stored entry code, then microprocessor U5 asserts output signal OUT3 (node 118). Because output signal OUT3 is pulled up by passive pull up resistor R9, output signal OUT3 is normally high and is pulled down when asserted. The output signal OUT3 is connected to both inputs of NAND gate U6A. Thus, NAND gate U6A functions as an inverter and the output signal OUT3 is inverted. The output signal (node 119) of NAND gate U6A is thus a positive-going signal when asserted. Accordingly, transistor Q3 is turned on when output signal OUT3 is asserted.

When transistor Q3 is turned on, the pre-charged voltage on capacitor C3 is dumped into magnet 125. More specifically, transistor Q3 is turned on for a given time duration (such as 10 ms) which causes capacitor C3 to discharge through the coil of magnet 125 from 91V to 6V. In this manner, magnet 125 provides the necessary magnetic flux for engaging the latch of the lock assembly. In one embodiment, transistor Q3 is a high voltage transistor capable of handling the 91 volts dumped onto magnet 125 and the resulting high current pulse.

Operation of Electrical Circuit

The overall operation of electrical circuit 100 will now be described in more detail. When the lock is in its idle state, transistors Q2 and Q3 are turned off and electrical circuit 100 is powered off. No power is drawn. When the first tap of the code entry button is detected as a positive-going step at the first input node 102, transistors Q2 is turned on to power up microprocessor U5. Microprocessor U5 immediately process various tasks to prepare the microprocessor for the code comparison and magnetization operations. For instance, the stored entry code is retrieved from the non-volatile memory.

Meanwhile, the microprocessor provides a stream of pulses to drive transistor Q1 for charging capacitor C3, using the current provided by batteries BT1 and BT2. The microprocessor U5 charges up the voltage at capacitor C3 to the desired level (91V). While the precharging is taking place, the microprocessor U5 continues to look for the remaining taps corresponding to the entry code. When the program switch SW2 has not been actuated and when the input code received via number switch SW1 matches the stored entry code, the microprocessor U5 turns on transistor Q3 and magnet 125 is activated. On the other hand, if the program switch SW2 is actuated the required number of times, then the input code is stored in the internal non-volatile memory of microprocessor U5.

Battery

The electrical circuit 100 of the lock assembly of the present invention operates at very low power so that an extended battery life is achieved. In one embodiment, a lithium battery is used and up to 11-13 years of battery life is realized. When the battery power runs out, the lock of the present invention can still be operated using a key.

Referring at FIG. 9, in the present embodiment, a parallel connection of two batteries BT1 and BT2 is used. By putting two batteries in parallel, more current is realized. The batteries provide current to charge capacitor C3 as well as to power up the microprocessor and the logic circuitry. In one embodiment, the battery voltage remains at 3 volts. Since the operating voltage range of the microprocessor is 2 to 5.5 volts, the system will continue to operate until the battery voltage drops below 2 volts. The current to run the microprocessor is 0.5 mA at 3 volts. On the other hand, the current to operate the voltage boost circuit is 18 mA for 500 to 700 milliseconds. The high current demand by the voltage boost circuit may cause the voltage of batteries BT1 and BT2 to drop by 0.2 to 0.3 volts.

The battery consumption, due to the magnet, can be calculated as follows. The batteries provide 440 mA-Hr. For 0.7 seconds, the current is 20 mA. During the additional time, which is used to enter the code and turn on the magnet, the current consumption is 0.5 mA. Thus, the lock can be operated approximately 80,000 times before the batteries will run out.

The batteries of the electrical circuit need to withstand high temperature for installation on external doors. Also, the batteries need to have to have a long shelf life. This is because the lock will be off most of the time and only turn on once in a while for a few seconds. In one embodiment, batteries BT1 and BT2 are lithium ion batteries, such as the CR2032 batteries. Lithium battery is the best choice because lithium batteries have long shelf life and can withstand high temperatures.

In one embodiment, the battery charge level is measured by the microprocessor U5 to determine the remaining life of the batteries. For instance, the battery charge level is measured by measuring the time it takes for capacitor C3 to be charged up to the desired level. The charge time measurement is an indication of the battery charge level. Various means can be used to provide the user with an indication of a low battery level. For example, an LED light or a buzzer can be used. Alternately, the electrical circuit can cause the entry code to not function every other time to alert the user that the battery is running out.

Alternate Embodiments

FIG. 9 illustrates one embodiment of the electrical circuit of the present invention. FIG. 9 is illustrative only and is not intended to be limiting. Other circuit components can be used to realize the basic function described above. For example, electrical circuit 100 uses MOS transistors Q2 and Q3. In other embodiments, bipolar transistors can be used to implement transistors Q2 and Q3. The selection of the transistor type is based on the speed and power required for the electrical circuit.

In one embodiment, the electrical circuit of the electronic combination lock is formed using discrete components placed on a printed circuit board. In other embodiments, an integrated circuit can be formed to integrate most or all of the components of the electrical circuit. The only circuit element that may not be integrated is logic gate U6B since it is used to realize the ground disconnection.

In the above embodiment, the electrical circuit employs a microprocessor having on-states that are active low. In other embodiments, the electrical circuit can be constructed using a microprocessor having on-states that are active high. In that case, the polarities of the logic circuits and electrical nodes for the switches will have to be modified accordingly, as understood by one of ordinary skill in the art.

In the above description, the entry code is entered using momentary taps of the code entry button to represent each digit of the entry code and pauses to separate the group of taps associated with each digit. As such, only a single code entry button is used for inputting the entry code. According to an alternate embodiment of the present invention, a second button—an enter button—is provided on the external door handle. The enter button is coupled to actuate a third switch—an enter switch—in the electrical circuit. The enter button is used as the separation between groups of taps of the code entry button representing separate digits of the entry code.

In one embodiment, the code entry button and the enter button are formed as separate, individual buttons. In another embodiment, the code entry button and the enter button can be formed using a rocker switch having a first position for engaging the number switch and a second position for engaging the enter switch.

When an enter button is provided in addition to the code entry button, the entry code is entered as follows. Momentary taps of the code entry button are used to represent the digits of the entry code and the enter button is pushed between the taps of each digit to signify the separation of the groups of taps. For example, for an entry code of "32416" where "O" represents a momentary tap of the code entry button and "E" represents a tap of the enter button, the "32416" entry code is entered into the electrical circuit as sequential taps as follows: OOO E OO E OOOO E O E OOOOOO E, where the very first tap initiates the power up process of the electrical circuit. By using the enter button, there is no restriction on the time duration between the momentary taps and the pauses. The code entry process is thus made more easy to use and foolproof.

Figure 15:
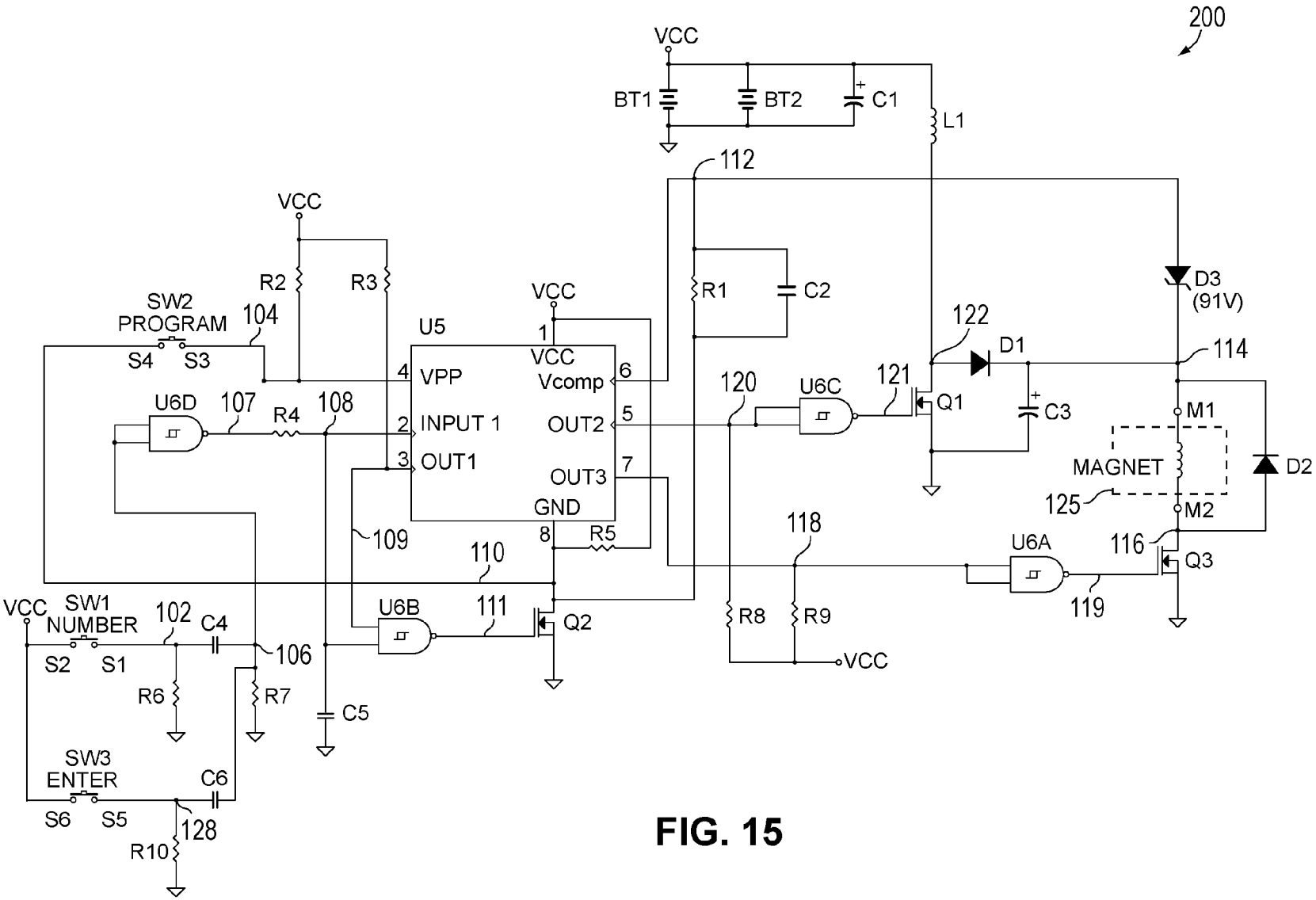
FIG. 15 is a circuit diagram of an electrical circuit for operating the lock assembly according to an alternative embodiment of the present invention.

FIG. 15 is a circuit diagram of an electrical circuit for operating the lock assembly according to an alternative embodiment of the present invention. Referring to FIG. 15, electrical circuit 200 is constructed in the same manner as electrical circuit 100 of FIG. 9 except with the addition of the enter switch SW3, resistor R10 and capacitor C6. The microprocessor U5 in electrical circuit 200 is programmed accordingly to include instruction codes for recognizing the input signal from the enter switch SW3. Like elements in FIGS. 9 and 15 are given like reference numerals and will not be further described.

In electrical circuit 200, tapping of the enter button actuates the enter switch (SW3). When the enter switch (SW3) is actuated, the switch electrically shorts the two switch terminals S5 and S6 together. In the present embodiment, the first switch terminal (S5) of switch SW3 is the third input node (128) of electrical circuit 200 while the second switch terminal (S6) is connected to the power supply Vcc voltage. Thus, whenever the enter switch SW3 is closed, the third input node (128) is shorted to the VCC voltage.

The actuation of the enter switch SW3 generates a third input signal ("the enter signal") at a node 128. In the present embodiment, a conditioning circuit for the third input signal is provided to convert each actuation of the enter switch SW3 into a pulse. More specifically, the conditioning circuit for the enter signal includes a resistor R10 and a capacitor C6 to generate an RC decay based on the capacitance of capacitor C6. In the event that the enter button is stuck and the enter switch SW3 is permanently engaged, the electrical circuit will still shut off so as not to run down the battery.

In the present embodiment, the first input signal ("the number signal") from the number switch SW1 and the third input signal (the enter signal) from the enter switch share the same input terminal INPUT1 of the microprocessor U5. In electrical circuit 200, the number signal is coupled through capacitor C4 to node 106 of resistor R7 while the enter signal is coupled through capacitor C6 to the same node. The two signals share a single signal path from node 106 to node 108 which is the input terminal INPUT1 of microprocessor U5.

Microprocessor U5 is programmed to distinguish the number signal from the enter signal based on the pulse width of the respective signal. Thus, the conditioning circuits for the number signal and the enter signal also serve the additional function of generating pulses of different pulse width. In one embodiment, the enter signal has a pulse width that is at least twice as long as the number signal. Microprocessor U5 measures the pulse width of the input signal at the INPUT1 terminal to determine if the input signal is the number signal or the enter signal. In one embodiment, capacitor C6 has a capacitance twice that of capacitor C4 so that the pulse width of the enter signal is at least twice as long as the pulse width of the number signal.

FIG. 15 illustrates an alternate embodiment where an enter switch is included to simplify the code entry process and make the code entry process more foolproof. FIG. 15 is illustrative only and is not intended to be limiting. Other methods for incorporating the enter switch into the electrical circuit of FIG. 9 is possible, including coupling the enter signal as a separate signal to the microprocessor.

Deadbolt

According to another aspect of the present invention, the electronic combination lock can be applied to a deadbolt to allow keyless access of a deadbolt. The electronic combination lock of the present invention is based on modifications that are made to conventional deadbolts employing the standard multi-pin lock escapement or standard pin tumbler lock. The basic construction of deadbolt is described in U.S. Pat. No. 6,502,436 B2, which patent is incorporated herein by reference in its entirety. The electronic combination lock of the present invention modifies the basic deadbolt locks and adapts the basic multi-pin cylinder locks for keyless entry.

Figure 11:
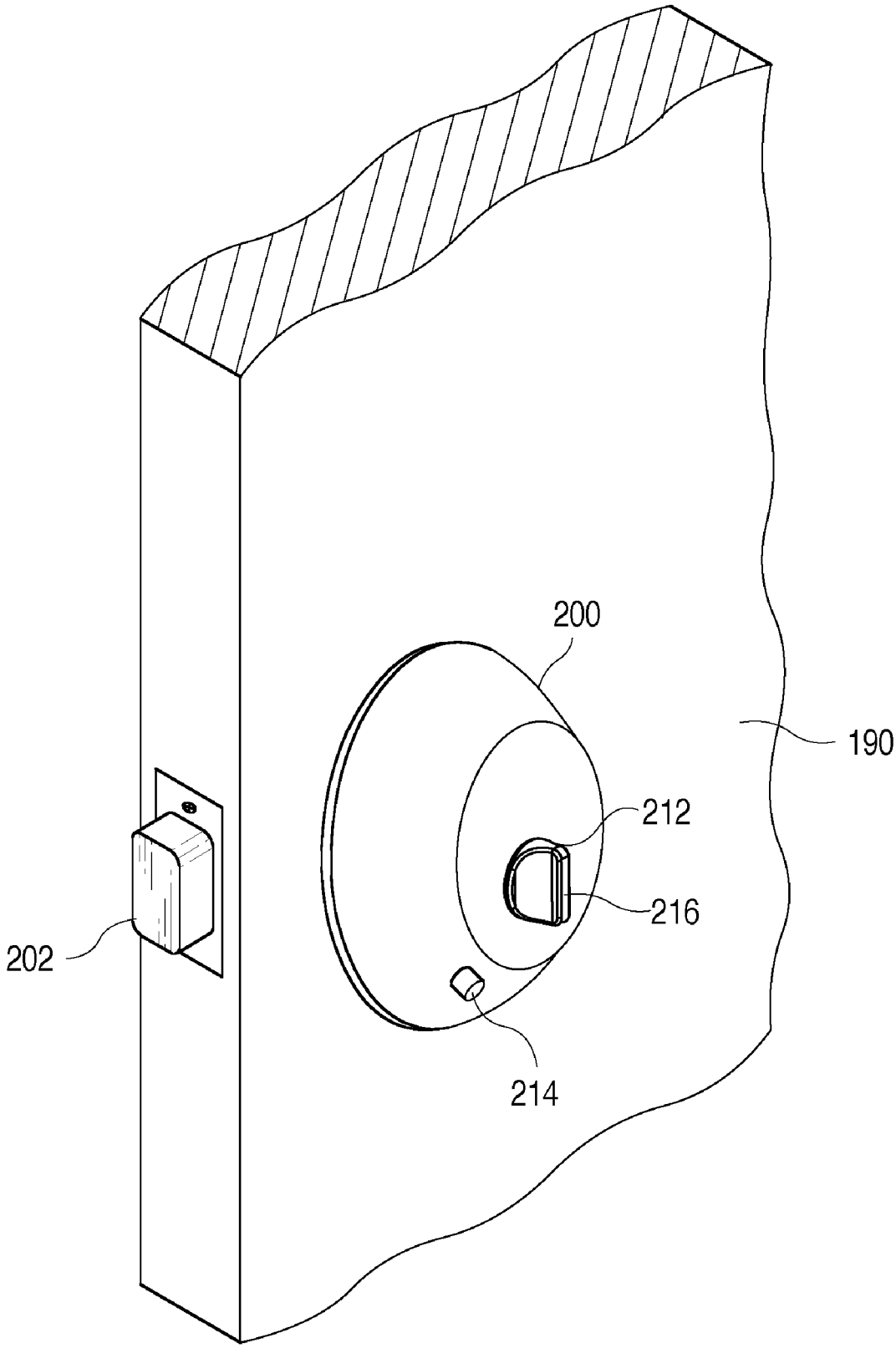
FIG. 11 illustrates a deadbolt implemented as an electronic combination lock according to one embodiment of the present invention.

FIG. 11 illustrates a deadbolt implemented as an electronic combination lock according to one embodiment of the present invention. Referring to FIG. 11, a deadbolt lock for a door 190 includes an external handle 200 for external access, an internal handle (also called a "thumb turn") for internal operation, and a bolt 202 for engaging a mating recess in the door jamb. Deadbolt door handler 200 is constructed as a conventional deadbolt lock except for a turn knob 212 for enabling keyless rotation of the cylinder and a code entry button 214 for entry of an input code. In a deadbolt, the rotation of the cylinder extends or retracts the bolt for locking or unlocking the door. Keyed entry is enabled through a key slot 216.

The electronic combination lock for a deadbolt is constructed in the same manner as described above with reference to a standard door lock except for the deadbolt lock structure. The lock assembly is constructed in the same manner as described above except for the provision of an additional flat on the bottom of the cylinder. The electrical circuit for the deadbolt is the same as described above and will not be further described.

Figure 12A:
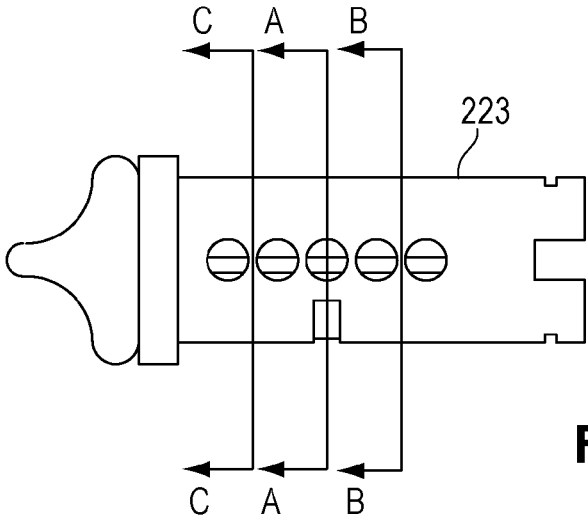
FIGS. 12A and 12B are the top and bottom views of the lock cylinder for a deadbolt according to one embodiment of the present invention.
Figure 12B:
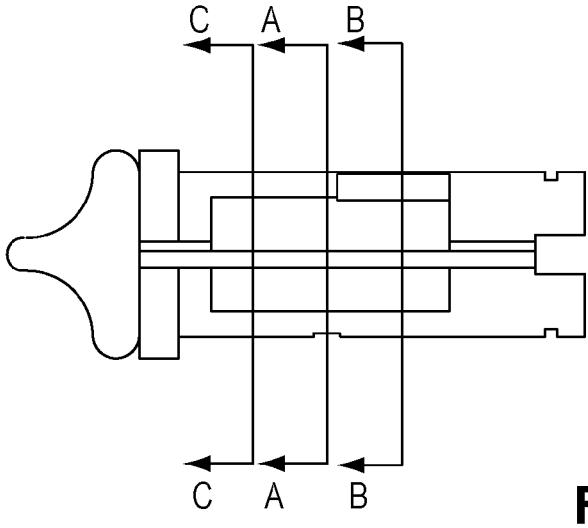
Figure 12C:
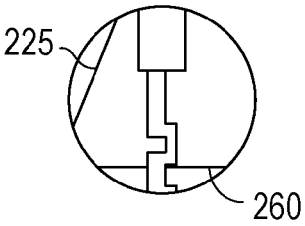
FIG. 12C is the cross-sectional view of the lock cylinder across the line A showing the reset cam path and the bottom flat according to one embodiment of the present invention.
Figure 12D:
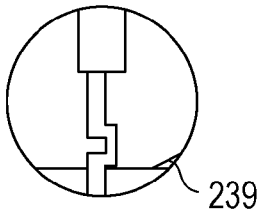
FIG. 12D is the cross-sectional view of the lock cylinder across the line B showing the program cam path and the bottom flat according to one embodiment of the present invention.
Figure 12E:
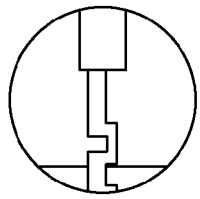
FIG. 12E is the cross-sectional view of the lock cylinder across the line C showing the bottom flat according to one embodiment of the present invention.

FIGS. 12A and 12B are the top and bottom views of the lock cylinder for a deadbolt according to one embodiment of the present invention. FIG. 12C is the cross-sectional view of the lock cylinder across the line A showing the reset cam path and the bottom flat according to one embodiment of the present invention. FIG. 12D is the cross-sectional view of the lock cylinder across the line B showing the program cam path and the bottom flat according to one embodiment of the present invention. FIG. 12E is the cross-sectional view of the lock cylinder across the line C showing the bottom flat according to one embodiment of the present invention.

Figure 13A:
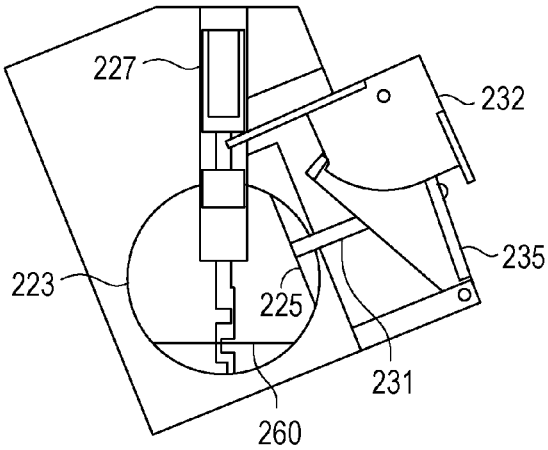
FIGS. 13A-13D are cross-sectional views illustrating the unlock operation of the electronic combination deadbolt lock according to one embodiment of the present invention.

FIGS. 13A-13D are cross-sectional views illustrating the unlock operation of the electronic combination deadbolt lock according to one embodiment of the present invention. Referring to FIG. 13A, the deadbolt is in the home position and the deadbolt is locked. The lift lock pins 227 are dropped down into the bores of the cylinder 223. The lift comb 232 and the latch 235 are engaged. The cylinder 223 cannot be rotated.

Figure 13B:
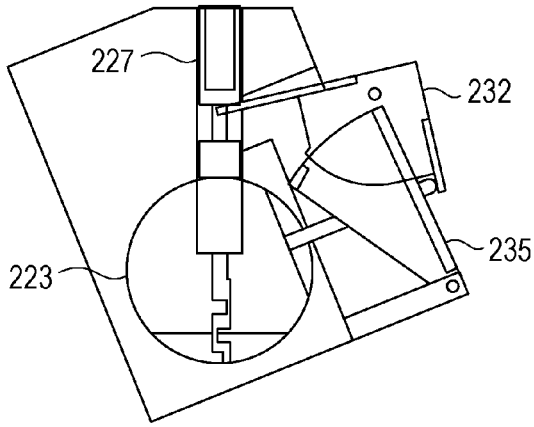
Figure 13C:
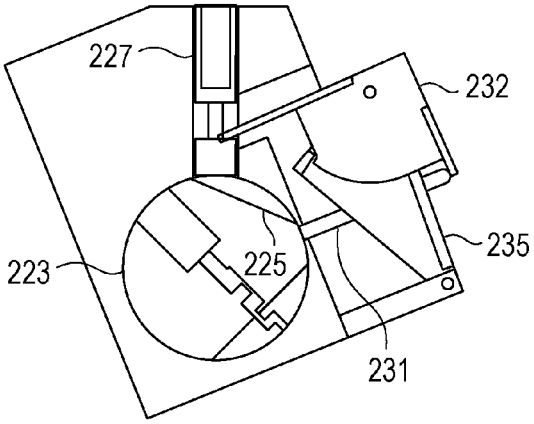
Figure 13D:
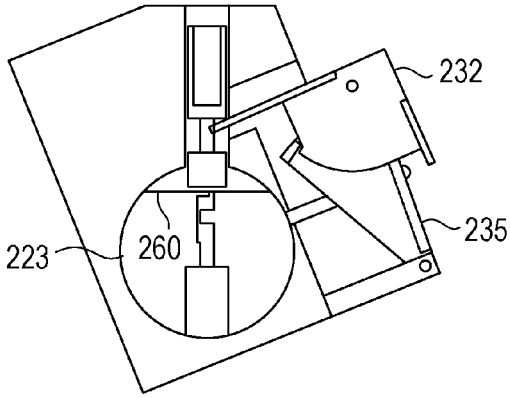

Referring to FIG. 13B, when the correct entry code is entered, the magnet pulls on the latch 235 and the lift comb 232 is released to lift the lift lock pins 227 out of the cylinder bores. The cylinder can now be rotated to retract the bolt. In a deadbolt, the cylinder must first be rotated 90 degrees clockwise from the home position to extend the deadbolt plunger and then the cylinder is rotated counter-clockwise to 180 degrees from the home position to retract the bolt.

When the cylinder is rotated between 30 to 40 degrees (FIG. 13C), the latch reset cam path 225 acts on the latch reset pin 231 and the lift comb 232 is pushed down to engage with the latch 235. The lift lock pins 227 remains lifted out of the cylinder. The cylinder continues to be rotated counter-clockwise to the 180 degrees position (FIG. 13D) in order to fully retract the bolt. The bottom flat 260 of the cylinder 223 eliminates part of the key slot used to guide the key to prevent the lift lock pins from falling into the key slot. Without bottom flat 260, the lift lock pins 227 can fall into the key guide slot when the cylinder is rotated 180 degrees. With the bottom flat 260, the lift lock pins 227 are able to stay clear of the circumference of the cylinder and allow the cylinder to be rotated back to its home position.

The locking operation of the deadbolt is similar to the standard lock described above and will not be further described.

Figure 14A:
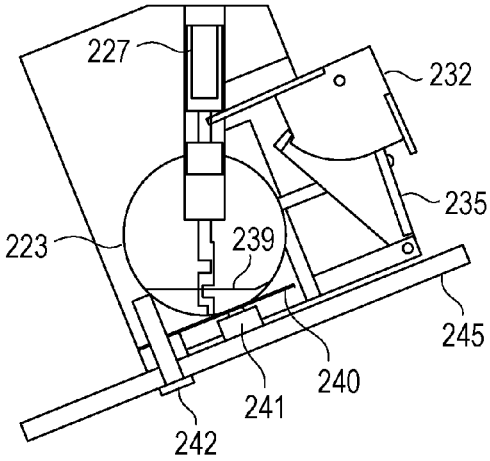
FIGS. 14A-14D are cross-sectional views illustrating the code programming operation of the electronic combination deadbolt lock according to one embodiment of the present invention.
Figure 14B:
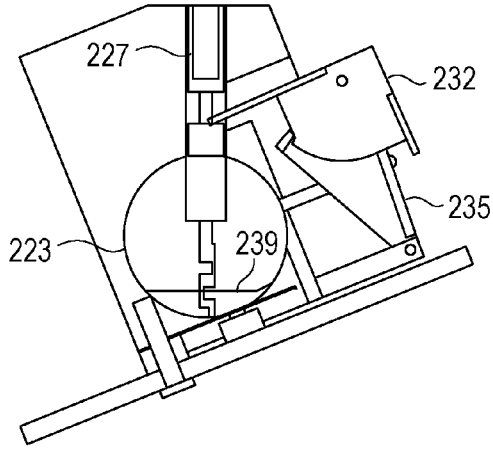

FIGS. 14A-14D are cross-sectional views illustrating the code programming operation of the electronic combination deadbolt lock according to one embodiment of the present invention. Referring to FIG. 14A, the deadbolt is in the home position and the cylinder is locked. The code programming cam path 239 does not engage the code program reed 240 and the code program reed 240 does not press on the program switch 241, which is formed on a printed circuit board 245 with the printed circuit board 245 secured to the lock body by a bolt 242. When programming of a new entry code is desired, the new entry code is entered using the code entry button. Then, the key is inserted into the cylinder to lift the lift lock pins out of the cylinder (FIG. 14B). The cylinder is now ready to be rotated under the influence of the key. Note that the key can be inserted and then the new entry code is entered. The order of the key insertion and new code entry is not critical to the practice of the present invention.

Figure 14C:
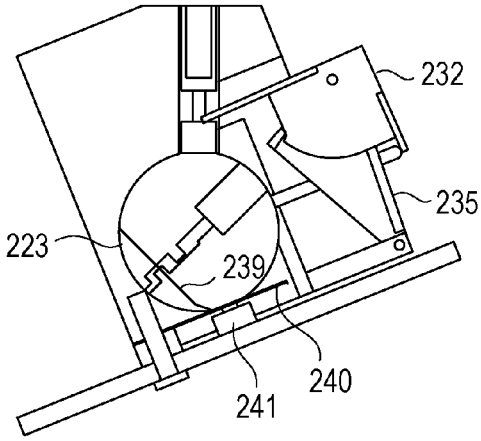
Figure 14D:
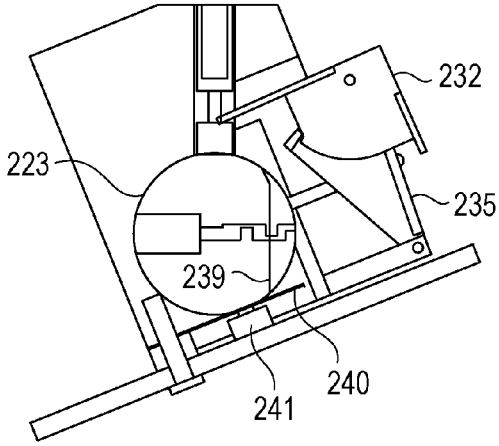

With the key inserted and the new entry code entered, the cylinder is rotated using the key from its home position to about 45 degrees clockwise (FIG. 14C). As a result of the rotation, the code programming cam path 239 pushes on the reed 240 and the reed engages the program switch 241. The electrical circuit thus detects one actuation of the program switch. Then, still using the key, the cylinder is rotated counter-clockwise past the home position to about 90 degrees counter-clockwise from vertical (FIG. 14D). As a result of this second rotation, a second actuation of the program switch 241 is realized by the code programming cam path 239 pressing on the code program reed 240.

In the present embodiment, two actuations of the program switch within a predetermined time duration are required for the electrical circuit to complete the code programming operation. When two actuations of the program switch are detected by the electrical circuit, the entry code entered previously will be stored in the integrated circuit as the new entry code.

Advantages

The electronic combination lock of the present invention provides many advantages over conventional combinational locks.

First, the electronic combination lock of the present invention is built upon existing multi-pin lock or pin-tumbler lock structure including one or more pins. The lock assembly can be readily adapted into the basic multi-pin or pin-tumbler lock structure with minimum retooling.

Second, the electronic combination lock of the present invention can be unlocked using either a key or the entry code. Allowing the use of the key provides a backup means of unlocking in the event that the electronic circuit does not function or the batteries are run down.

Third, the electronic combination lock can be operated in the dark and is therefore advantageous for the visually impaired persons. The electronic combination lock of the present invention also provides additional safety because the use of the single code entry button renders the entry code not readily observable as compared to the use of a numerical key pad. The electronic combination lock is thus more secure.

Fourth, the electronic combination lock is compact and can be incorporated entirely in the external door handle. No electronic components outside of the external door knob are required. Thus, the electronic combination lock is made for easy installation. In particular, the electronic combination lock of the present invention can be made to be compatible with existing door locks so that with only two screws the old lockset can be removed and replaced with the inventive lockset.

Fifth, the electronic combination lock of the present invention is low cost and requires very low power. Because of its low cost and low power consumption and thus its long battery life, it is anticipated that the user will simply discard the lock and install a new lock when the battery runs down. Maintenance of the electronic combination lock is thus greatly simplified.

Lastly, the electronic combination lock of the present invention is designed so that it can withstand static electricity buildup. In most applications, the locks are installed in areas with carpet where static electricity can build up. Also, dry weather increases static electricity build-up. Static electricity can affect the electrical circuits installed in the door handle. Conventional electronic locks often suffer from static electricity problem where the electrical circuit is damaged by static charge when the user touches the door handle. Conventional solutions to the static electricity problem include using two layers of enclosure where an inner enclosure shields the electrical circuit from the outer enclosure. Using two layers of enclosure increases the cost of the lock assembly significantly.

However, in accordance with the present invention, the electronic combination lock can be housed in spherical door handle. The best anti-static structure is a sphere because charge always stays on the outside of the sphere. Thus, by housing the entire electrical circuit in the external door handle which can be made to have a spherical shape, the electrical circuit is protected from static electricity discharge. The external door handle acts as a faraday shield for the electronic components of the electronic combination lock. Thus, the electronic combination lock of the present invention can withstand high static charge and does not require additional shielding enclosure, thereby reducing the cost of the lock.

The above detailed descriptions are provided to illustrate specific embodiments of the present invention and are not intended to be limiting. Numerous modifications and variations within the scope of the present invention are possible. The present invention is defined by the appended claims.

We claim:

1. An electronic combination lock for keyed and keyless access, comprising:

a door handle having a turn button and a code entry button formed thereon, the code entry button capable of receiving an input code of sequential digits in the form of groups of momentary taps of the code entry button, each group of momentary taps of the code entry button being associated with a digit of the input code and groups of momentary taps forming the sequential digits of the input code, the door handle housing a lock assembly and an electrical circuit;

the lock assembly comprising:

a lock body including an axial opening for housing a cylinder movable within the lock body and one or more vertical bores for housing one or more spring loaded lift lock pins and one or more lift lock pin force springs, each of the one or more lift lock pin force springs applying a spring-loaded force to a respective one of the one or more spring loaded lift lock pins;

the cylinder comprising a key slot for engaging a key to operate the lock, and one or more bores for accommodating one or more key pins with variable length matching a pattern on the key, the one or more bores being aligned with the one or more vertical bores of the lock body to allow the one or more key pins to be positioned under the one or more spring loaded lift lock pins, each of the one or more spring loaded lift lock pins being associated with a respective one of the one or more key pins, the one or more spring loaded lift lock pins being positioned at least partially in the bores of the cylinder in a locked position, the cylinder further comprising a latch reset cam path which engages a latch reset pin when the cylinder is rotated and a code programming cam path which engages a program switch when the cylinder is rotated, wherein the cylinder is rotated within the axial opening by the key or the turn button when the one or more spring loaded lift lock pins are lifted out of the cylinder;

a lift comb comprising fingers for engaging the one or more spring loaded lift lock pins and a notch, the lift comb being mounted on a first rod and spring loaded by a lift comb spring to pivot about the first rod to lift the one or more spring loaded lift lock pins out of the cylinder in an unlock position;

a latch comprising a finger for engaging the notch of the lift comb, the latch being mounted on a second rod and spring loaded by a torsion spring to pivot about the second rod to engage the lift comb, wherein the latch reset pin, when engaged by the latch reset cam path, pushes the lift comb against a spring-loaded force of the lift comb spring to cause the lift comb to be engaged with the latch; and a magnetic coil being selectively activated by the electrical circuit to engage the latch, the magnetic coil pulling the latch against a spring-loaded force of the torsion spring to cause the latch to release the lift comb, wherein the electrical circuit receives a first input signal from a number switch being actuated by the code entry button and a second input signal from the program switch, the electrical circuit being operative to store an entry code when the program switch is actuated and to activate the magnetic coil when an input code matching the stored entry code is received for providing keyless access, wherein when the input code entered through the code entry button matches the stored entry code, the magnetic coil is activated to pull on the latch to release the lift comb, the lift comb lifting the one or more spring loaded lift lock pins out of the cylinder to allow the cylinder to be rotated within the axial opening using only the turn button, thereby providing keyless access.

2. The electronic combination lock of claim 1, wherein the cylinder is operable to engage a door latch locking mechanism to lock or unlock a spring-driven door latch.

3. The electronic combination lock of claim 1, wherein the cylinder is operable to engage a cam for extending or retracting a bolt.

4. The electronic combination lock of claim 1, wherein the input code is configured to accept a group of momentary taps of the code entry button to represent each digit of the input code and pauses to separate the groups of momentary taps associated with each digit of the sequential digits of the input code.

5. The electronic combination lock of claim 1, wherein the door handler further comprises an enter button, wherein the input code is configured to accept a group of momentary taps of the code entry button to represent each digit of the input code and a momentary tap of the enter button to separate the groups of momentary taps associated with each digit of the sequential digits in ut code.

6. The electronic combination lock of claim 1, wherein each of the one or more lift lock pin force springs is positioned above a respective one of the one or more spring loaded lift lock pins in a respective vertical bore of the lock body for applying the spring-loaded force onto the respective spring loaded lift lock pin to cause the pin to extend into the respective bore of the cylinder.

7. The electronic combination lock of claim 1, wherein the lift comb spring is coupled to the lift comb for applying the spring-loaded force to cause the lift comb to pivot, and the torsion spring is coupled to the latch for applying the spring-loaded force to cause the latch to engage the lift comb.

8. The electronic combination lock of claim 1, wherein the lock assembly further comprises a code program reed disposed between the code programming cam path and the program switch, the code program reed being engaged by the code programming cam path to actuate the program switch when the cylinder is rotated.

9. The electronic combination lock of claim 8, wherein the cylinder is rotated clockwise or counter-clockwise to actuate the program switch.

10. The electronic combination lock of claim 9, wherein the electrical circuit is operative to store the input code entered via the code entry button as the entry code when the key is inserted in the key slot and the program switch is actuated one or more times within a predetermined time duration by turning the cylinder clockwise or counter-clockwise using the key.

11. The electronic combination lock of claim 9, wherein the electrical circuit is operative to store the input code entered via the code entry button as the entry code when the key is inserted in the key slot and the program switch is actuated twice within a predetermined time duration by turning the cylinder clockwise and counter-clockwise using the key.

12. The electronic combination lock of claim 1, wherein the electrical circuit comprises:

an input signal conditioning circuit for receiving the first input signal at the number switch and converting each actuation of the number switch to a signal pulse;

a power activation circuit for allowing power from at least one battery to be provided to the electrical circuit upon the receipt of the first signal pulse corresponding to the first actuation of the number switch;

a voltage boost circuit for generating a charge voltage at a first node, the charge voltage to be applied to activate the magnetic coil; and a microprocessor receiving the second input signal actuated by the program switch and the signal pulses corresponding to the first input signal, the microprocessor operative to store the input code as the entry code when the program switch is actuated and operative to compare the input code with the stored entry code when the program switch is not actuated, the microprocessor further operative to apply the charge voltage to the magnetic coil when the input code matches the stored entry code.

13. The electronic combination lock of claim 12, wherein the at least one battery further comprises a first battery and a second battery electrically connected in parallel to supply power to the electrical circuit.

14. The electronic combination lock of claim 5, wherein the electrical circuit comprises:

a first input signal conditioning circuit for receiving the first input signal at the number switch and converting each actuation of the number switch to a signal pulse having a first pulse width;

an enter switch actuated by the enter button;

a second input signal conditioning circuit for receiving a third input signal at the enter switch and converting each actuation of the enter switch to a signal pulse having a second pulse width different from the first pulse width;

a power activation circuit for allowing power from a battery to be provided to the electrical circuit upon the receipt of the first signal pulse corresponding to the first actuation of the number switch;

a voltage boost circuit for generating a charge voltage at a first node, the charge voltage to be applied to activate the magnetic coil; and a microprocessor receiving the second input signal actuated by the program switch and the signal pulses corresponding to the first input signal and the third input signal, the microprocessor operative to store the input code as the entry code when the program switch is actuated and operative to compare the input code with the stored entry code when the program switch is not actuated, the microprocessor further operative to apply the charge voltage to the magnetic coil when the input code matches the stored entry code.

15. The electronic combination lock of claim 14, wherein the microprocessor receives the first input signal and the third input signal on the same input terminal, the microprocessor distinguishing the first and third input signals based on the first and second pulse widths.

16. A lock assembly for an electronic combination lock for keyed and keyless access, comprising:

a lock body including an axial opening for housing a cylinder movable within the lock body and one or more vertical bores for housing one or more spring loaded lift lock pins and one or more lift lock pin force springs, each of the one or more lift lock pin force springs applying a spring-loaded force to a respective one of the one or more spring loaded lift lock pins;

the cylinder comprising a key slot for engaging a key to operate the lock, and one or more bores for accommodating one or more key pins with variable length matching a pattern on the key, the one or more bores being aligned with the one or more vertical bores of the lock body to allow the one or more key pins to be positioned under the one or more spring loaded lift lock pins, each of the one or more spring loaded lift lock pins being associated with a respective one of the one or more key pins, the one or more spring loaded lift lock pins being positioned at least partially in the bores of the cylinder in a locked position, the cylinder further comprising a latch reset cam path which engages a latch reset pin when the cylinder is rotated, wherein the cylinder is capable of being rotated within the axial opening when the one or more spring loaded lift lock pins are lifted out of the cylinder, wherein, when the key is engage with the key slot, the cooperation of the pattern of the key and the one or more key pins provides the keyed access;

a lift comb comprising fingers for engaging the one or more spring loaded lift lock pins and a notch, the lift comb being mounted on a first rod and spring loaded by a lift comb spring to pivot about the first rod to lift the one or more spring loaded lift lock pins out of the cylinder in an unlock position;

a latch comprising a finger for engaging the notch of the lift comb, the latch being mounted on a second rod and spring loaded by a torsion spring to pivot about the second rod to engage the lift comb, wherein the latch reset pin, when engaged by the latch reset cam path, pushes the lift comb against a spring-loaded force of the lift comb spring to cause the lift comb to be engaged with the latch; and a magnetic coil being capable of being selectively activated to engage the latch, the magnetic coil pulling the latch against a spring-loaded force of the torsion spring to cause the latch to release the lift comb, wherein when the magnetic coil is activated with an input code to pull on the latch to release the lift comb, the lift comb lifts the one or more spring loaded lift lock pins out of the cylinder to allow the cylinder to be rotated within the axial opening, thereby providing keyless access.

17. The lock assembly of claim 16, wherein the cylinder is operable to engage a door latch locking mechanism to lock or unlock a spring-driven door latch.

18. The lock assembly of claim 16, wherein the cylinder is operable to engage a cam for extending or retracting a bolt.

19. The lock assembly of claim 16, wherein each of the one or more lift lock pin force springs is positioned above a respective one of the one or more spring loaded lift lock pins in a respective vertical bore of the lock body for applying the spring-loaded force onto the respective spring loaded lift lock pin to cause the pin to extend into the respective bore of the cylinder.

20. The lock assembly of claim 16, wherein the lift comb spring is coupled to the lift comb for applying the spring-loaded force to cause the lift comb to pivot, and the torsion spring is coupled to the latch for applying the spring-loaded force to cause the latch to engage the lift comb.

21. The lock assembly of claim 16, further comprising a turn button formed on the key slot of the cylinder, the turn button being rotated to rotate the cylinder when the cylinder is in the unlock position.

22. The lock assembly of claim 21, wherein the turn button is formed integrated with the key slot of the cylinder.

* * * * *

UNITED STATES PATENT AND TRADEMARK OFFICE

CERTIFICATE OF CORRECTION

PATENT NO. : 7,712,341 B2
APPLICATION NO. : 11/847209
DATED : May 11, 2010
INVENTOR(S) : Fritz Hugo Johansson and James P. Davidson It is certified that error appears in the above-identified patent and that said Letters Patent is hereby corrected as shown below:

Column 22
Claim 5, Line 7, where "digits in ut code" should read --digits of the input code--.

Column 24
Claim 16, Line 5, where "engage" should read --engaged--.

Signed and Sealed this
Eighth Day of March, 2011

David J. Kappos

David J. Kappos
*Director of the United States Patent and Trademark Office*